US007081077B2

(12) United States Patent
Southwell et al.

(10) Patent No.: US 7,081,077 B2
(45) Date of Patent: Jul. 25, 2006

(54) DISPLAYABLE MODULAR CONTAINER FOR PRODUCE

(75) Inventors: James D. Southwell, Long Grove, IL (US); Keith A. Jackson, Gurnee, IL (US)

(73) Assignee: Packaging Corporation of America, Lake Forest, IL (US)

( * ) Notice: Subject to any disclaimer, the term of this patent is extended or adjusted under 35 U.S.C. 154(b) by 123 days.

(21) Appl. No.: 10/694,965

(22) Filed: Oct. 27, 2003

(65) Prior Publication Data

US 2004/0089702 A1 May 13, 2004

Related U.S. Application Data

(63) Continuation of application No. 09/693,033, filed on Oct. 20, 2000, now Pat. No. 6,676,012.

(60) Provisional application No. 60/161,126, filed on Oct. 22, 1999.

(51) Int. Cl.
*B31B 1/14* (2006.01)

(52) U.S. Cl. ..... 493/68; 493/79

(58) Field of Classification Search ..... 493/68, 493/69, 70, 51, 79, 104
See application file for complete search history.

(56) References Cited

U.S. PATENT DOCUMENTS

| | | | | |
|---|---|---|---|---|
| 1,653,116 | A | 12/1927 | Parks | 229/191 |
| 1,664,308 | A | 3/1928 | Miller | 229/919 |
| 3,144,190 | A | 8/1964 | Holt et al. | 229/120.17 |
| 3,820,706 | A | 6/1974 | Gibson et al. | 229/34 |
| 3,863,831 | A | 2/1975 | Wozniacki et al. | 229/23 |
| 3,871,570 | A | 3/1975 | Garmon | 229/31 |
| 3,910,484 | A | 10/1975 | Wozniacki | 229/34 |
| 3,940,053 | A | 2/1976 | Putman et al. | 229/34 |
| 3,990,624 | A | 11/1976 | Melli | 229/170.17 |
| 4,053,098 | A | 10/1977 | Baptist | 229/23 |
| 4,053,100 | A | 10/1977 | Baptist | 229/43 |
| 4,082,215 | A | 4/1978 | Eichenauer | 229/36 |
| 4,101,048 | A | 7/1978 | Rieben et al. | 229/34 |
| 4,151,948 | A | 5/1979 | de la Fuente, Jr. | 229/34 |
| 4,175,691 | A | 11/1979 | Cornell et al. | 229/36 |
| 4,192,443 | A | 3/1980 | McLaren | 229/120.17 |
| 4,291,830 | A | 9/1981 | Sorensen | 229/45 |
| 4,304,351 | A | 12/1981 | Stollberg | 229/23 |
| 4,335,843 | A | 6/1982 | Kent | 229/27 |
| 4,347,969 | A | 9/1982 | Kost et al. | 229/34 |
| 4,349,147 | A | 9/1982 | Jensen | 229/34 |
| 4,385,721 | A | 5/1983 | Olsen et al. | 229/32 |
| 4,391,405 | A | 7/1983 | Drinon | 229/31 |
| 4,418,863 | A | 12/1983 | Kimbrell, Sr. | 229/49 |
| 4,537,344 | A | 8/1985 | Thomas | 229/34 |
| 4,567,996 | A | 2/1986 | Muise | 220/416 |
| 4,600,142 | A | 7/1986 | Quaintance | 229/143 |
| 4,613,045 | A | 9/1986 | Watson | 206/512 |
| 4,676,429 | A | 6/1987 | Crowe et al. | 229/109 |
| 4,770,339 | A | 9/1988 | Weimer | 229/143 |
| 4,848,648 | A | 7/1989 | Eisman | 229/120.17 |
| 4,883,221 | A | 11/1989 | Brundage | 229/143 |

(Continued)

FOREIGN PATENT DOCUMENTS

FR 2728867 A1 12/1994

(Continued)

*Primary Examiner*—Sameh H. Tawfik
(74) *Attorney, Agent, or Firm*—Jenkens & Gilchrist

(57) ABSTRACT

A stackable produce container is formed from a flat one-piece blank, typically of corrugated paper stock. The container has reinforced corners and is divided into compartments by transverse ribs which provide resistance to bulging under load and when exposed to high humidity.

6 Claims, 28 Drawing Sheets

U.S. PATENT DOCUMENTS

| | | | | |
|---|---|---|---|---|
| 4,946,093 | A | 8/1990 | Moorman | 229/128.19 |
| 5,000,377 | A | 3/1991 | McClure | 229/154 |
| 5,002,224 | A | 3/1991 | Muise | 229/169 |
| 5,052,615 | A | 10/1991 | Ott Edward et al. | 229/182 |
| 5,125,567 | A | 6/1992 | McClure | 229/150 |
| 5,139,196 | A | 8/1992 | Fry et al. | 229/157 |
| 5,163,609 | A | 11/1992 | Muise, Jr. | 229/113 |
| 5,261,594 | A | 11/1993 | Brown et al. | 229/191 |
| 5,285,956 | A | 2/1994 | Piepho | 229/191 |
| 5,289,970 | A | 3/1994 | McClure | 229/143 |
| 5,294,044 | A | 3/1994 | Clark | 229/191 |
| 5,330,094 | A | 7/1994 | Mertz | 229/167 |
| 5,361,975 | A | 11/1994 | Droste et al. | 229/120.34 |
| 5,361,976 | A | 11/1994 | Blomfield | 229/148 |
| 5,370,303 | A | 12/1994 | Fry | 229/143 |
| 5,392,985 | A | 2/1995 | Smith et al. | 229/125 |
| 5,452,848 | A | 9/1995 | Mur Gimeno | 229/191 |
| 5,487,504 | A | 1/1996 | Baird | 229/191 |
| 5,516,034 | A | 5/1996 | Jensen et al. | 229/120 |
| 5,535,941 | A | 7/1996 | Garza | 229/191 |
| 5,649,663 | A | 7/1997 | Pestow, Jr. | 229/190 |
| 5,673,848 | A | 10/1997 | Garza | 229/191 |
| 5,687,902 | A | 11/1997 | Tusing et al. | 229/198.1 |
| 5,704,193 | A | 1/1998 | Roe et al. | 53/397 |
| 5,860,590 | A | 1/1999 | Blomfield et al. | 229/165 |

FOREIGN PATENT DOCUMENTS

| | | |
|---|---|---|
| WO | WO 99/43560 | 9/1999 |

DISPLAYABLE MODULAR CONTAINER FOR PRODUCE

RELATED APPLICATIONS

This application is a continuation of U.S. patent application Ser. No. 09/693,033, filed Oct. 20, 2000 now U.S. Pat. No. 6,676,012 which is a complete application of provisional U.S. application Ser. No. 60/161,126, filed Oct. 22, 1999.

FIELD OF THE INVENTION

The present invention relates generally to containers for retaining, protecting and displaying articles and methods for making such containers. In particular, the present invention relates to a container having an open top formed from corrugated paperboard material which is useful in shipping and displaying perishable produce.

BACKGROUND OF THE INVENTION

Flat sheets of corrugated paperboard, typically referred to as blanks, have been used for many years as the starting material to form produce containers. Corrugated paperboard generally refers to a multi-layer sheet material comprised of two sheets of liner bonded to a central corrugated layer. Given a basic size requirement specified by the customer, industry standards and the preference for low cost, paperboard container manufacturers strive to provide structural stacking strength with a minimal amount of corrugated paperboard. A typical well-known container is a single piece tray design having a bottom wall, two side walls and two end walls, each of the side and end walls being hinged to the bottom wall. Typically, a single piece of corrugated paperboard will be cut and scored to form a flat blank that will then be folded into this container.

Typical containers for the support and transport of food produce articles are corrugated containers having fixed configurations. These containers can be unstable when stacked and are conducive to toppling. Many containers are not durable and flexible enough to protect and prevent damage to the produce. Furthermore, the side and bottom walls of produce containers are susceptible to buckling and twisting, leading to damage to the produce.

A packed container of produce will generally hold a weight suitable for handling by an individual. Such containers will generally be rectangular and have a variable height dimension. Further, these containers will normally be stacked for transport and storage. The cost of labor, i.e., the time required to handle the produce and assemble the shipping containers, can be significant factors in the overall cost of the produce. Many current produce containers can only be assembled by hand, a method that is costly and time consuming. Assembling paperboard containers for setup by a machine, where cooperating adjoining paperboard sections are adhesively bonded to form the produce container, can reduce cost and time.

It is important in the production, distribution and sale of perishable and non-perishable articles, such as produce, that the articles are safely and conveniently stored for transport and are safely and securely shipped for sale. Safe and secure storage and shipping is particularly a problem if heavy items must be placed in containers that stacked on each other. Stackable produce containers often acquire, for example, bulging side or end walls, deformed bottom walls, or smashed corners that damage the produce due to, for example, the weight or movement of the produce during shipment. Further, if the environment in which the paperboard container is shipped or stored is refrigerated, the moisture present is likely to be absorbed by and weaken the container.

Once the produce reaches a retail destination, the produce container is normally placed directly on display for consumer sale. This allows retailers to preserve time and money by not having to transfer produce into an alternative selling container. If a produce container arrives to a retailer in a crushed or damaged state, however, the retailer usually cannot, for aesthetic purposes, exhibit the produce container. Furthermore, produce containers generally contain at least one or more visible panels that have not been painted or coated. Retailers that sell produce directly in the container that emanates from the grower usually do not, for aesthetic reasons, desire consumers to see unpainted or uncoated surfaces.

Vertically-oriented corrugation within a produce container is typically stronger and more secure than horizontally-oriented corrugation. Without structural rigidity, containers at or near the bottom of a stack of produce containers could buckle under the weight of the containers stacked above them. Generally, the end walls of a produce container contain vertically-oriented corrugation. Thus, it is preferable for the end walls to contain as few openings as possible. Optimal cooling efficiency, which enhances produce quality and shelf life, is also desirable. Cooling may be achieved by including openings in the walls to allow cool air to flow from one side of the container to the other.

Accordingly, it is desirable to provide a container for transporting produce that is both durable and secure to prevent corrugation failure and produce damage, and which permits painting or coating on all visible surfaces, yet allows sufficient air flow to achieve optimal cooling efficiency.

SUMMARY OF THE INVENTION

The invention generally relates to a stackable produce container formed from a one-piece flat blank, typically of corrugated paper stock. The container is reinforced to permit use with heavy produce, such as melons, while resisting bulging of the side panels or bottom resulting from the load and/or the effects of high humidity.

In one aspect, the container of the invention is a rectangular, unitary structure having at least two compartments defined by side panels and a bottom panel, each compartment being separated from an adjacent compartment by a transverse rib and two vertical ribs. The four corners of the container are reinforced, preferably by at least one panel disposed at an angle to each of the adjacent side panels.

In one embodiment, the container of the invention has two compartments separated by one transverse rib and two vertical ribs which engage the ends of said transverse rib.

In a preferred embodiment, the top of the transverse rib is curved upwardly to increase the strength of the rib. In another preferred embodiment, the bottom of the transverse rib is curved upwardly to prestress the adjacent bottom panels.

In some embodiments, the vertical ribs engage the outside of the associated transverse rib. In other embodiments, the vertical ribs engage the inside of the associated transverse rib.

In some embodiments, the transverse rib has a height lower than the side walls of the container. In other embodiments, the transverse rib has the same height as the side walls of the container. In that case, the vertical ribs are modified but still support the transverse rib.

DESCRIPTION OF ILLUSTRATIVE EMBODIMENTS

Figure 1:
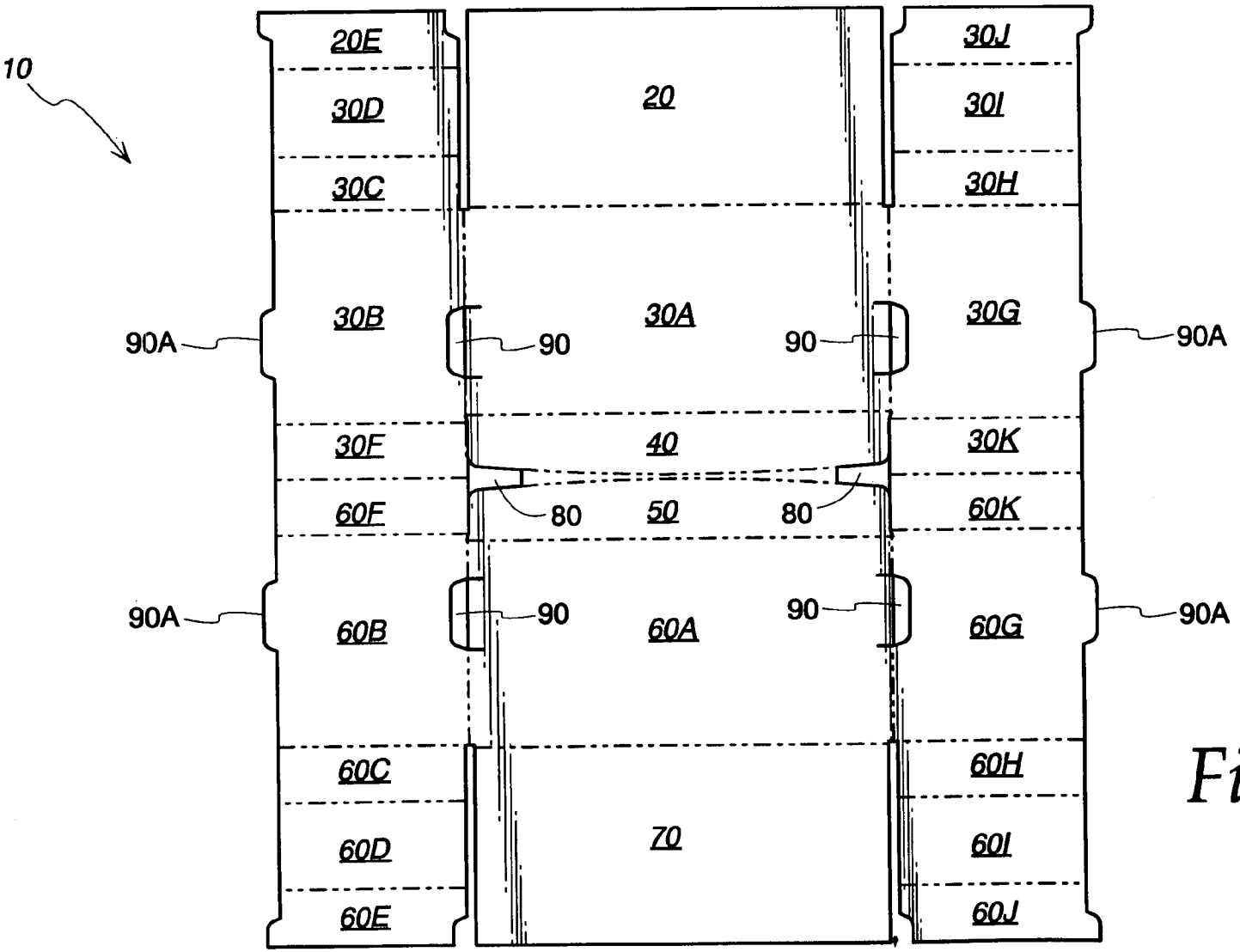
FIG. 1 is a plan view of a one-piece flat blank capable of being folded into a first container of the invention.

The invention in one aspect is a strong produce container (i.e., an open box) that is strengthened by transverse and vertical ribs which separate the container into compartments. The container will be illustrated in the Figures described below with respect to the simplest form, a two compartment container, but it will be understood that the containers of the invention may contain more than two compartments if additional pairs of transverse and vertical ribs are included. As has been previously discussed, produce containers, usually being made of corrugated paper board, tend to bulge under heavy loads, the bulging being accentuated by exposure to moisture, such as humid ambient conditions. For example, melons placed in a corrugated paper container will create a concentrated load, which is not distributed over the bottom of the container and tends to cause bulging. Bulging at the bottom or sides of stacked containers may cause damage to the melons during shipment. The present inventors have found it possible to provide a reinforced paperboard container for heavy produce which is capable of resisting bulging and consequent damage to the produce. The container itself has significant advantages for the user and, in addition, is particularly advantageous in that it is possible to make it from a one-piece blank, which can be folded by automated equipment, that is, it is a unitary construction. Although particularly useful for the transportation and display of heavy produce, it should be understood that containers of the invention may be useful in other applications.

The one-piece blank is foldable into a container that may be described as having at least six side panels and two bottom panels which form at least two compartments for produce, each pair of compartments being separated by at least one transverse rib, engaging the side walls of the container, in some embodiments through two vertical side ribs, the vertical ribs engaging the transverse rib at its ends. The transverse and vertical ribs are disposed at a 90° angle to the associated side or bottom panels. Each corner of the container is reinforced, in preferred embodiments by a panel disposed at an angle to each of the adjacent side panels.

The transverse and vertical ribs are formed by folding the blank along three substantially parallel scoring lines extending across the blank, the middle of the three fold lines forming the innermost part of each rib. In one embodiment, the middle fold line is a pair of fold lines slightly displaced from the centerline and curved to create a transverse rib which is higher in the middle to increase strength. Another effect of such a rib construction is that, while the transverse rib sides touch in the middle and can be glued for strength, the ends of the rib are separated at the side panels in order to provide an opening to receive one end of each of the vertical ribs. The ends of the transverse rib are notched to receive the ends of the vertical ribs. In another embodiment, the outer pair of fold lines are also curved in order to create a transverse rib which prestresses the bottom of the container. In another embodiment, the vertical ribs engage the outside of the transverse rib, rather than being inserted into the transverse rib.

The vertical ribs are formed by folding along three scoring lines substantially parallel to the fold lines for the transverse rib. As mentioned above, this is done simultaneously with the folding of the blank to form the transverse rib. The vertical ribs are generally not curved and, typically, the sides of the ribs touch upon forming and can be glued together for added strength.

Figure 32:
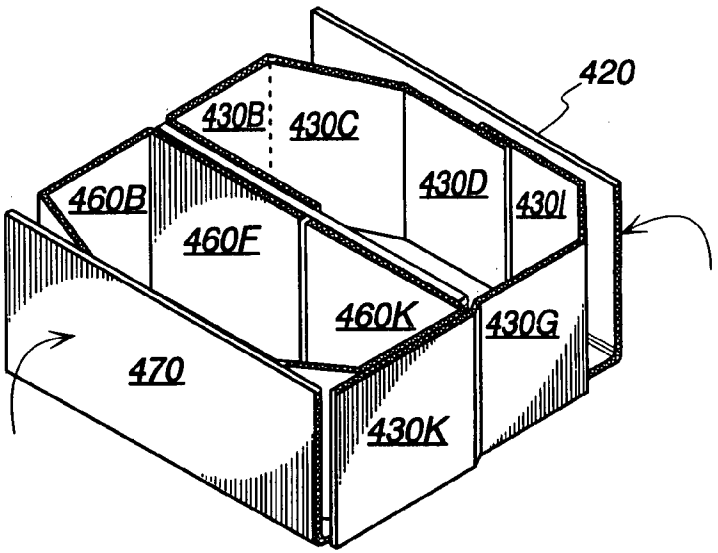
FIG. 32 shows the end panels folded into the vertical position to complete the fifth container of the invention.

As will be seen in the drawings, in some embodiments the transverse rib is lower than the side walls. However, the transverse rib can be as high as the side walls, if desired. In such embodiments, the vertical ribs may not take the form used when the transverse rib is lower than the side walls and thus, the vertical ribs are modified, as shown below in FIGS. 27 to 32. Instead of being folded in the center to form a vertical rib, the center line is cut to form reinforcing panels, which may be glued to both sides of the transverse rib or to one side of the transverse rib and to a side wall. Both of these possible arrangements are shown in FIGS. 30–32, although it is likely that one or the other would be chosen in any particular container.

The corners are reinforced by folding tabs created at the corners of the one-piece blank. In some embodiments, these tabs have two fold lines in addition to one at the junction with one of the side panels, so that they can be folded into a right triangular shape. One side is attached to the side panel, one is glued to the adjacent side panel, and the third extends between the two side panels at an angle to each. In another embodiment, the tabs have one additional fold line which, along with a fold line of the junction of the side panels, is used to fold a panel at an angle joining adjacent side panels. In an alternative embodiment (not shown in the figures), only one fold is made at a corner of the container and the tab is attached to an adjacent side wall, either on the inside or outside of the side wall.

The one-piece blank and the steps through which it can be folded into the reinforced container of the invention will be described now in reference to the drawings.

DESCRIPTION OF THE DRAWINGS

FIG. 1 shows a container of the invention in the form of a one-piece blank 10, which has been cut and scored to permit folding into the completed container. A list of the parts of the blank and the container for the embodiment of FIGS. 1–6 is given in the following chart. For convenience, six other embodiments are also described in FIGS. 7–44 and, in those drawings, the parts of the blanks described are numbered similarly, as will be noted below.

| Number | Description |
|---|---|
| 10 | blank for container |
| 20 | first longer side wall |

-continued

| Number | Description |
|---|---|
| 30A | first bottom |
| 30B | first short side wall |
| 30C, D, E | first corner reinforcement tab |
| 30G | second short side wall |
| 30H, I, J | second corner reinforcement tab |
| 40, 50 | transverse rib |
| 60A | second bottom |
| 60B | third shorter side wall |
| 60C, D, E | third corner reinforcement tab |
| 60G | fourth shorter side wall |
| 60H, I, J | fourth corner reinforcement tab |
| 30F, 60F | first vertical rib |
| 30K, 60K | second vertical rib |
| 70 | second longer side wall |
| 80 | transverse rib notches |
| 90 | side slots |
| 90A | side tabs |

Figure 2:
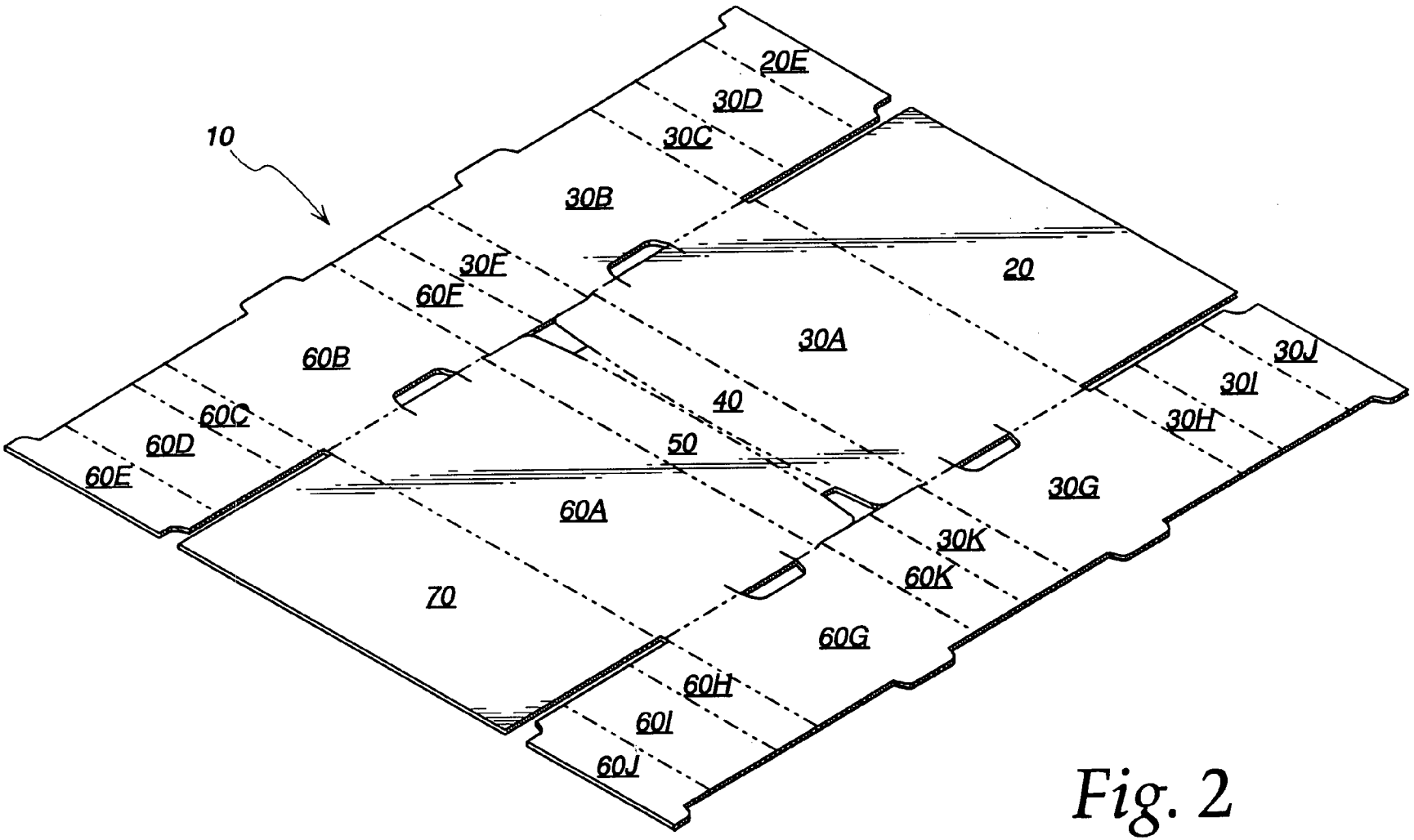
FIG. 2 is a perspective view of the one-piece blank of FIG. 1.
Figure 3:
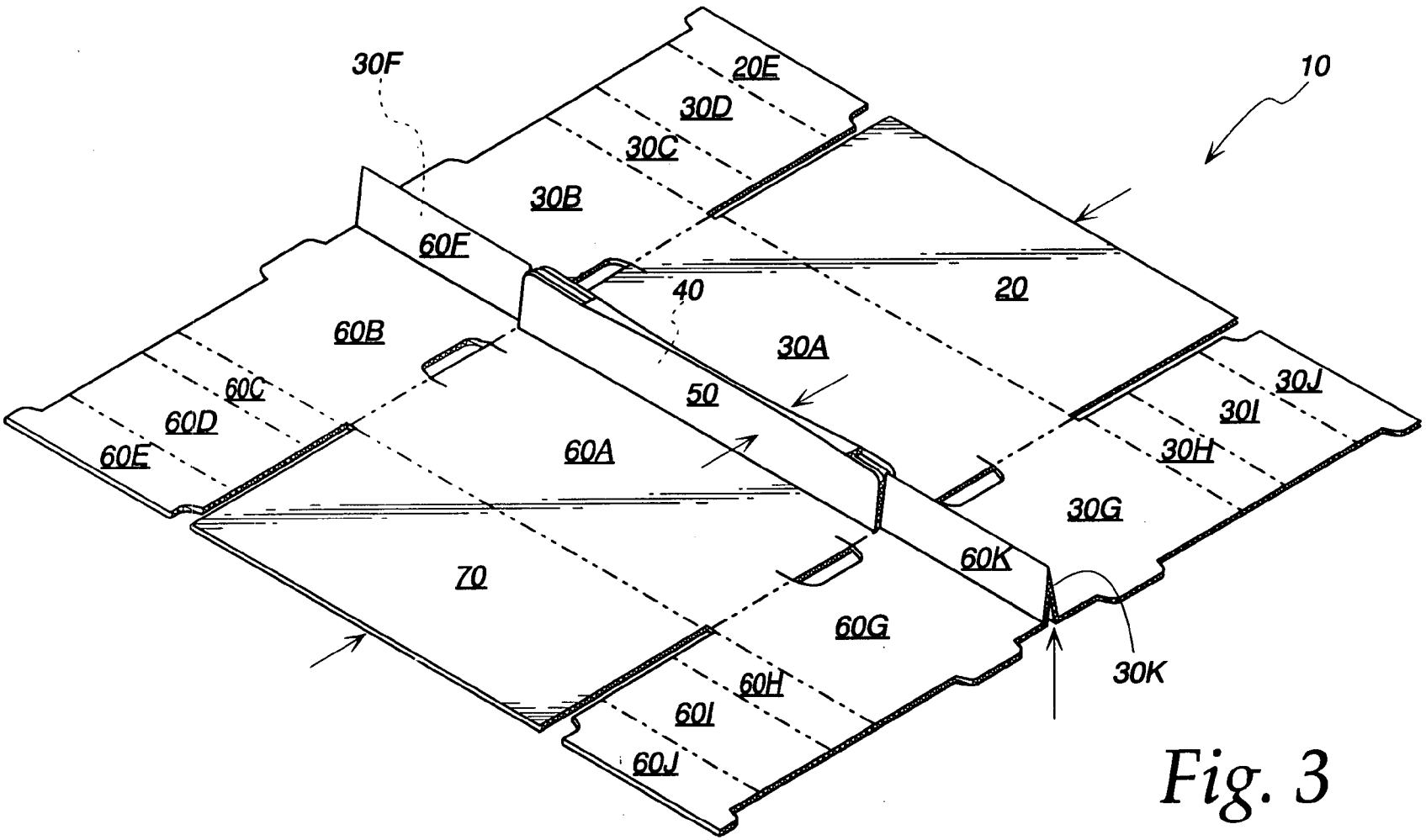
FIG. 3 shows the first fold of the one-piece blank of FIGS. 1 and 2 forming a transverse rib and two vertical ribs.

The blank 10 has been cut and scored to permit it to be folded into a reinforced container for shipping and handling heavy produce or other articles, if desired. FIG. 2 is a perspective view of blank 10. As completed, the container 10 will have two compartments separated by a transverse rib 40, 50 and vertical ribs 30F, 60F; 30K, 60K. The finished container has two long side walls 20 and 70, which could also be referred to as end walls where convenient. The shorter side walls are 30B, 30G, 60B, 60G. The transverse rib 40, 50 is made by folding in the direction vertical to the drawing along curved folds shown as dotted lines, as will be seen in FIG. 3. Folds are made where each side of the transverse rib 40, 50 joins the respective bottom panels 30A, 60A and brought into contact, completing the formation of the transverse rib 40, 50. It will be appreciated that the curved folds will form a curved upper portion of the transverse rib 40, 50. Also, as can be seen in FIG. 3, the right and left ends of the transverse rib 40, 50 will tend to be slightly separated, while the two sides will touch at the middle of rib 40, 50, and preferably can be glued together in order to provide additional stiffness.

Figure 4:
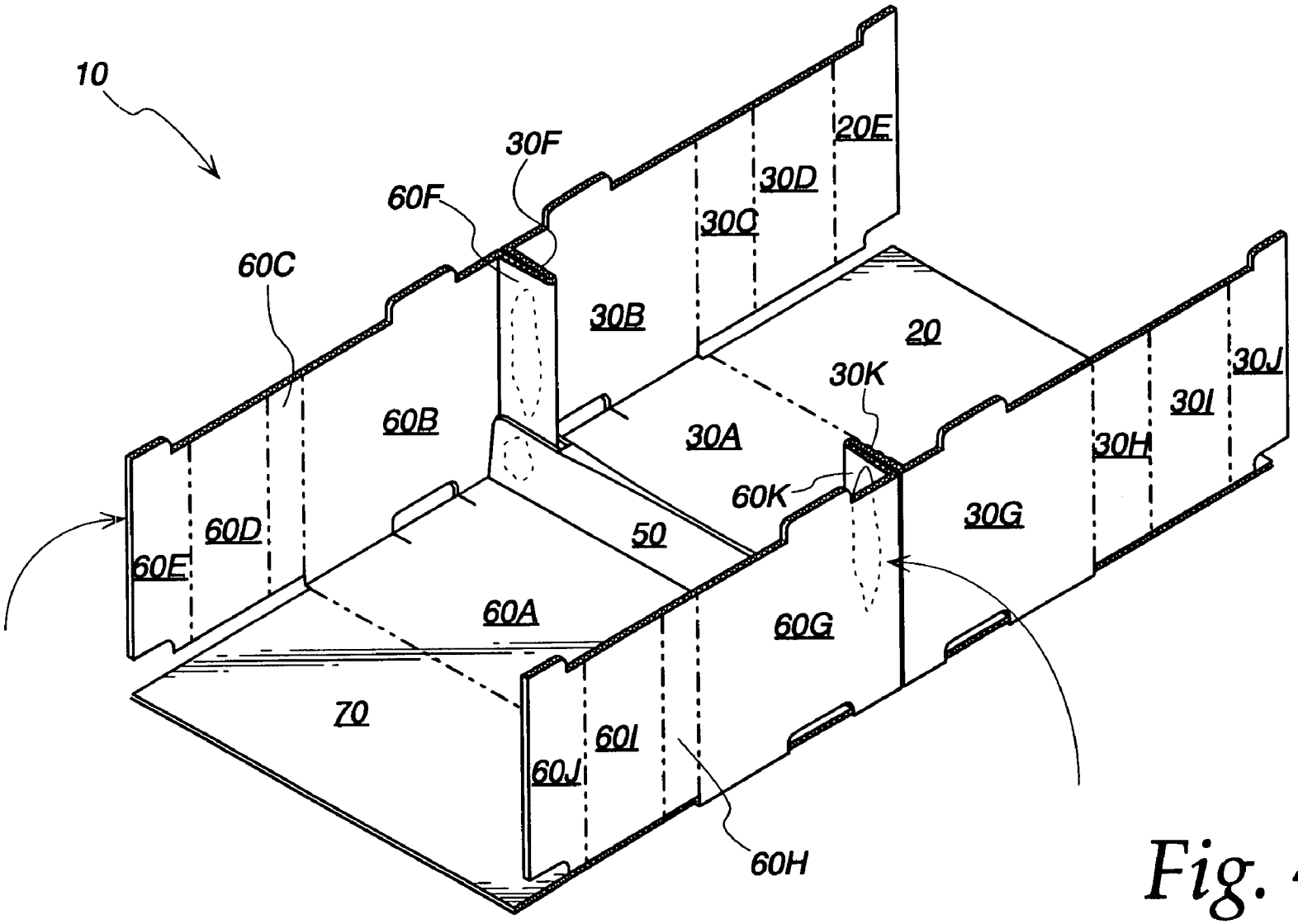
FIG. 4 shows the side panels of the blank of FIG. 3 folded into the vertical position and with the vertical ribs engaging the transverse ribs formed in FIG. 3.
Figures 5, 6:
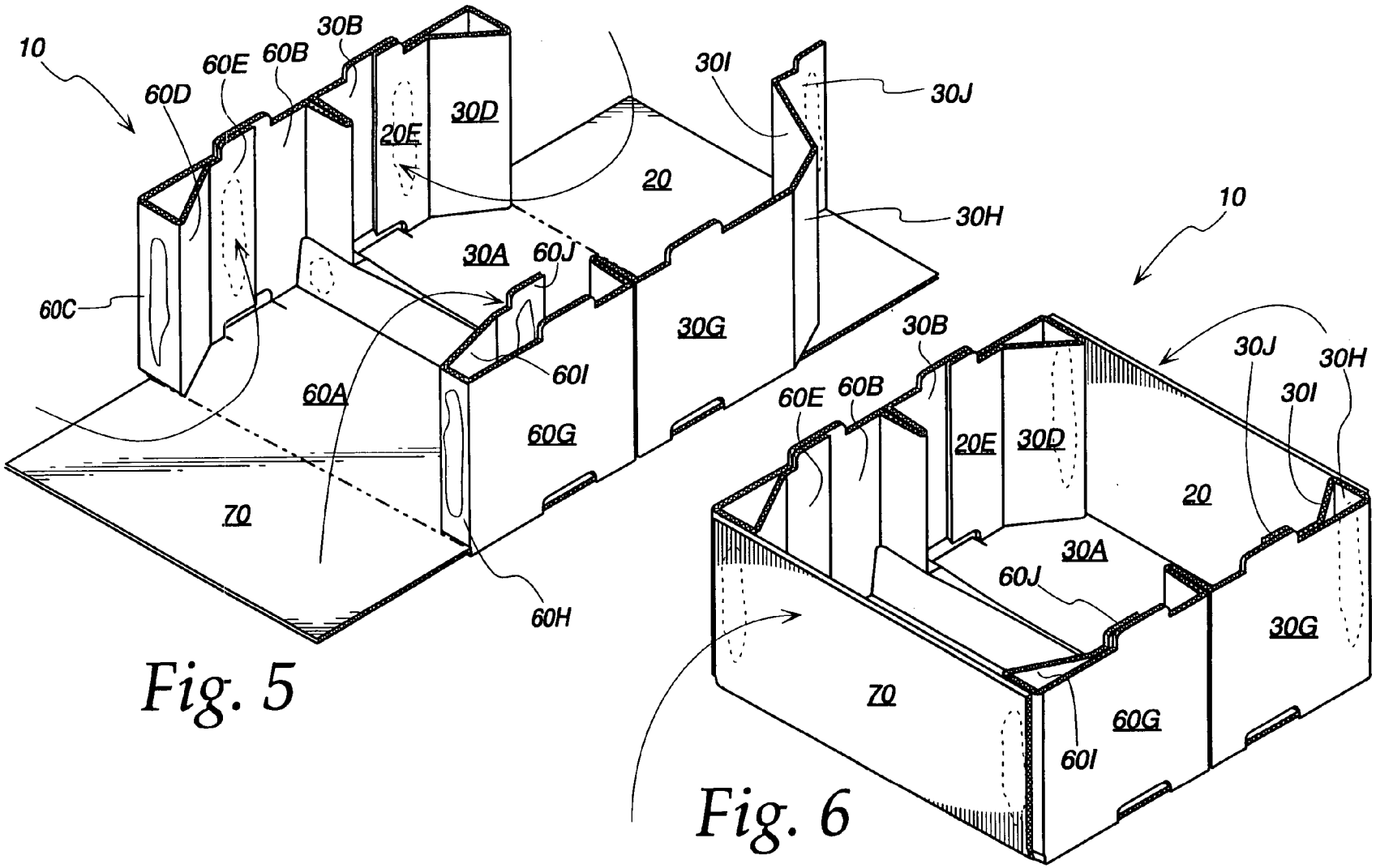
FIG. 5 shows the folding and positioning of the corner reinforcing tabs.
FIG. 6 shows the remaining side panels folded into place, completing a first container of the invention.

Each end of the transverse rib 40, 50 has been provided with a notch 80. These notches provide space for vertical ribs 30F, 60F; 30K, 60K to be inserted into the ends of the transverse rib 40, 50, where they can be secured by gluing if desired. Fold lines mark the edges of two vertical ribs 30F, 60F; 30K, 60K. When folds are made to form transverse rib 40, 50, the vertical ribs are also formed, as can be seen in FIG. 3. The vertical ribs 30F; 60F; 30K, 60K are moved into the notches 80 when the short side walls 30B, 30G, 60B, 60G are folded up, as shown in FIG. 4. Each of the corners of the container between the side panels is reinforced by tabs which, in this preferred embodiment, are folded into a right triangular shape. Alternatively, it is also possible to fold the tabs only where panels 30C and 30B meet and attach the tab to adjacent side wall 20. This construction will be evident to those skilled in the art and is not shown in the drawings. Corner reinforcement 30C, 30D, 30E is illustrative of a preferred embodiment. The portion 30D between fold lines will form an angle reinforcement of the corner where sides 20 and 30B meet when the folds have been completed. The panel 30E will be folded inward to rest against the short side wall 30B and typically will be glued for rigidity, as shown in FIG. 5. Panel 30C will rest against long wall 20, where it typically will be glued to secure the corner reinforcement panel 30D, which will be disposed at an angle between long wall 20 and short wall 30B. Each of the other corners of the container in this embodiment will be reinforced by folding and gluing the corresponding portions of the blank 10. Then, long side walls 20 and 70 are folded up along the fold lines as shown in FIG. 6, thus forming a container.

Side slots 90 have been cut in the blank 10 to serve as openings which can engage corresponding tabs 90A on a container below so that the containers are in registration with each other and positioned to best support the weight of the contained produce. Tabs 90A extend from short side walls 30B, 30G, 60B, 60G in the completed container and serve to engage the side slots 90 in a container placed immediately above it, as just discussed.

Containers of the invention provide a number of advantages over containers previously used for transportation of heavy produce, such as melons and the like. Substantial strength is provided by the horizontal and vertical ribs, which limit the deflection of the bottom and sides of the container under load. This, in turn, minimizes the tendency of the produce to be bounced vertically during transportation, which can cause damage to the produce, reducing its value and perhaps making it unsalable. The corner reinforcement helps to limit the deflection of the side walls, which can cause adjacent containers to allow their contents to come into contact, leading to potential damage. When the transverse rib 40, 50 is made with a curved top, as in FIGS. 1–6, additional strength is provided to the beam which has been formed by folding the corrugated paper stock. Since the center of the horizontal rib 40, 50 is wider at the ends than at the middle, space is provided for the vertical ribs 30F, 60F, 30K, 60K to be inserted into the notches 80 provided in ends of the transverse rib.

It should be understood that the features of the container just described can be varied, while still retaining the advantages of the invention. For example, the container could have more than one transverse rib, particularly if the container is longer than shown and additional strength is desired. If additional transverse ribs are used, they will be combined with vertical ribs, such as have been described above.

The added strength of a container of the invention avoids the previous practice of doubling the thickness of the portions of a container to limit bulging, either at the sides or the bottom. The positioning of the strengthening ribs will depend on the intended use, such as the size of the produce which the container will hold. Since the container is made from a single blank, as folded, the container will inherently have the corrugations positioned so that they provide the best strength. That is, the forces acting on the bottom and side walls will be acting against the preferred disposition of the strengthening corrugations.

Figure 7:
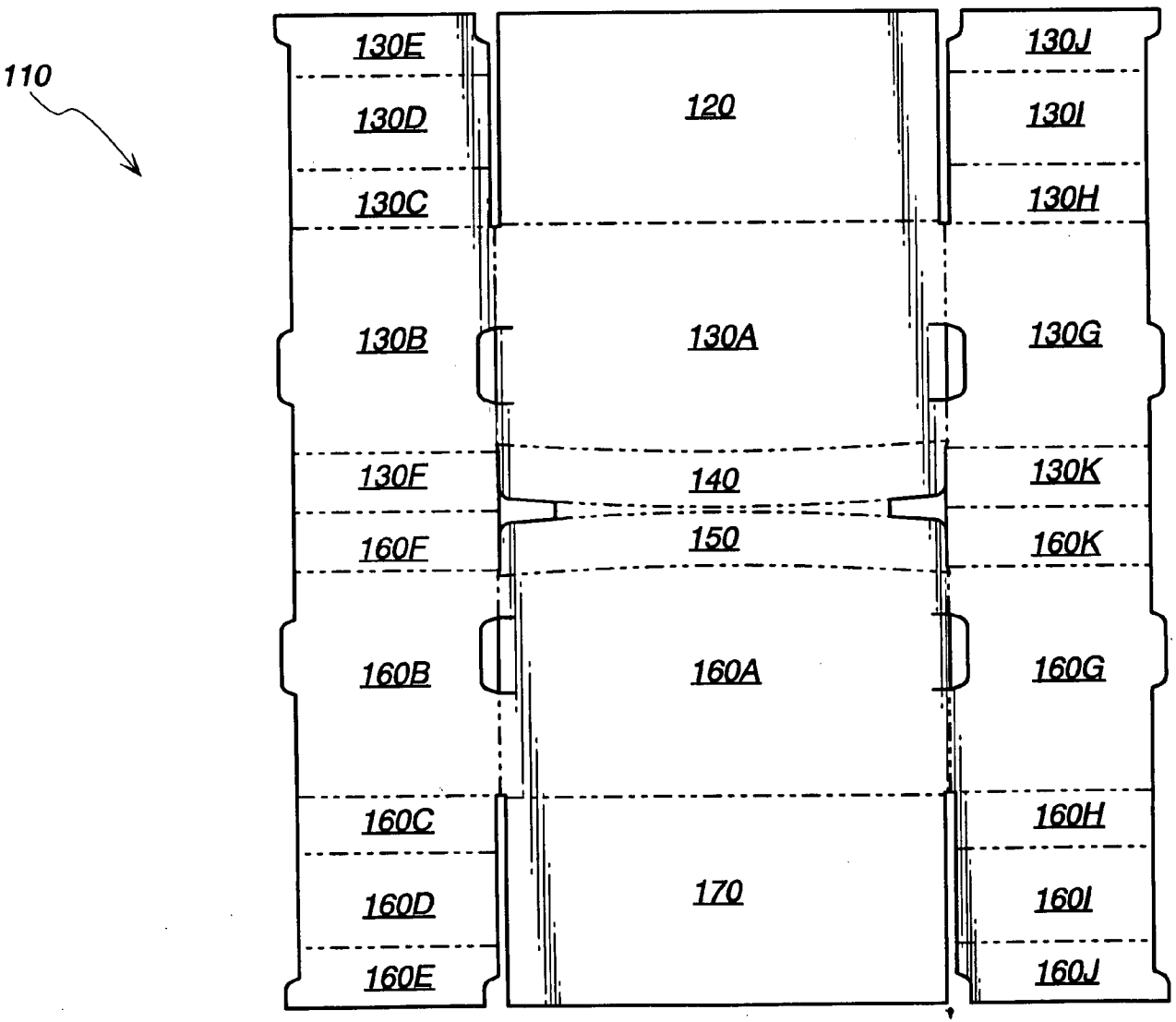
FIG. 7 is a plan view of a one-piece flat blank of a second embodiment of the invention.
Figure 8:
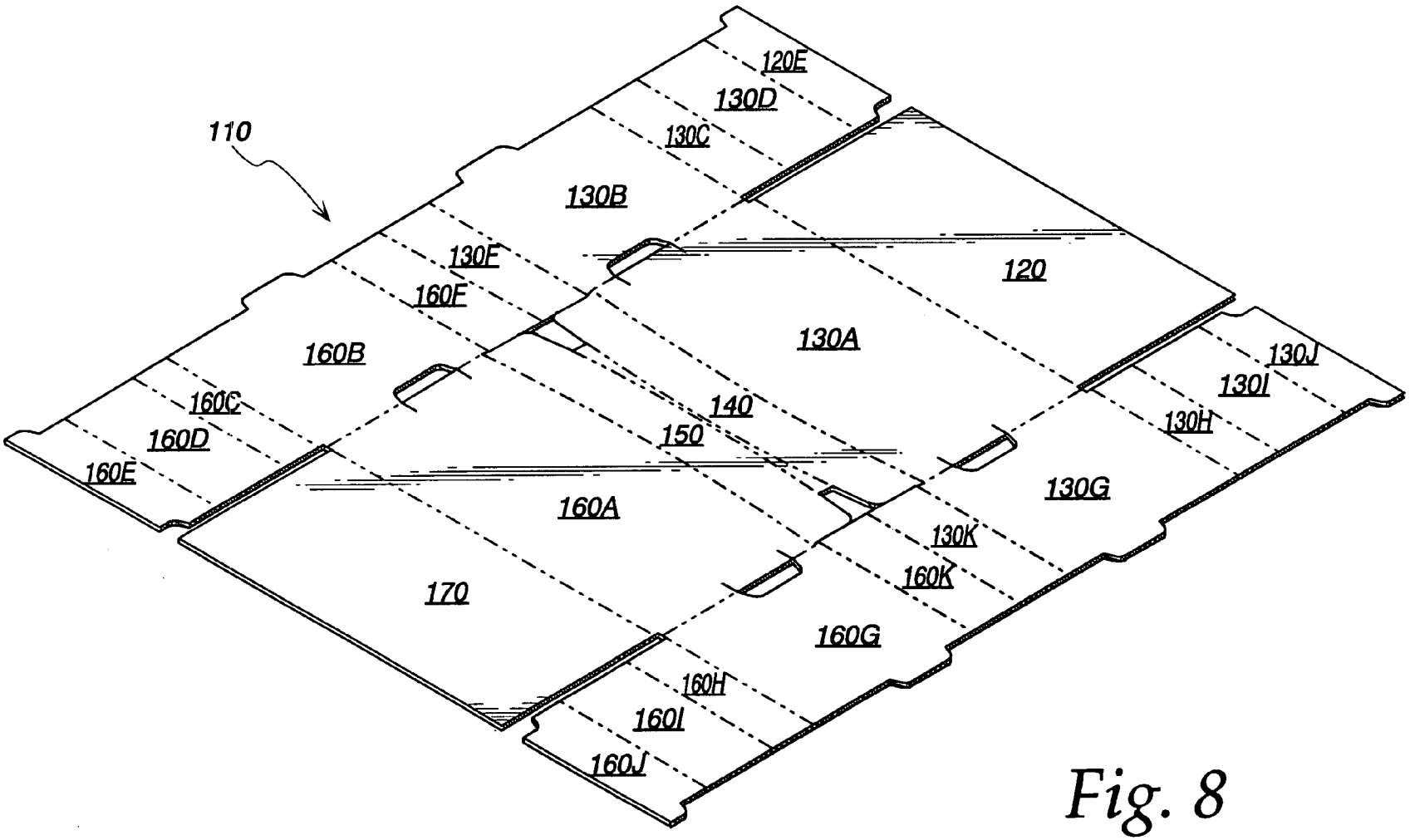
FIG. 8 is a perspective view of the one-piece blank of FIG. 7.
Figure 9:
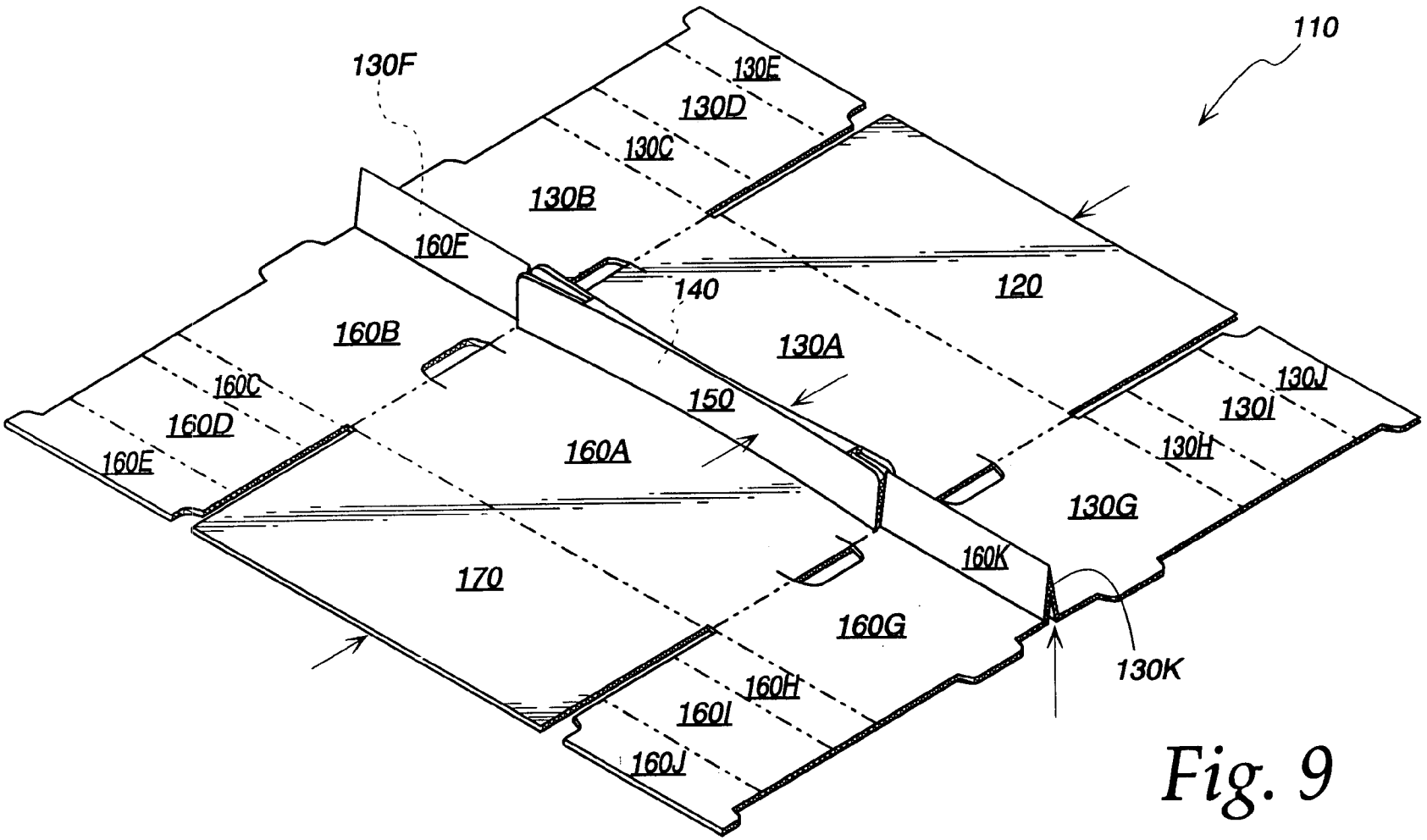
FIG. 9 shows the formation of a transverse rib and two vertical ribs from the blank of FIG. 7.
Figure 10:
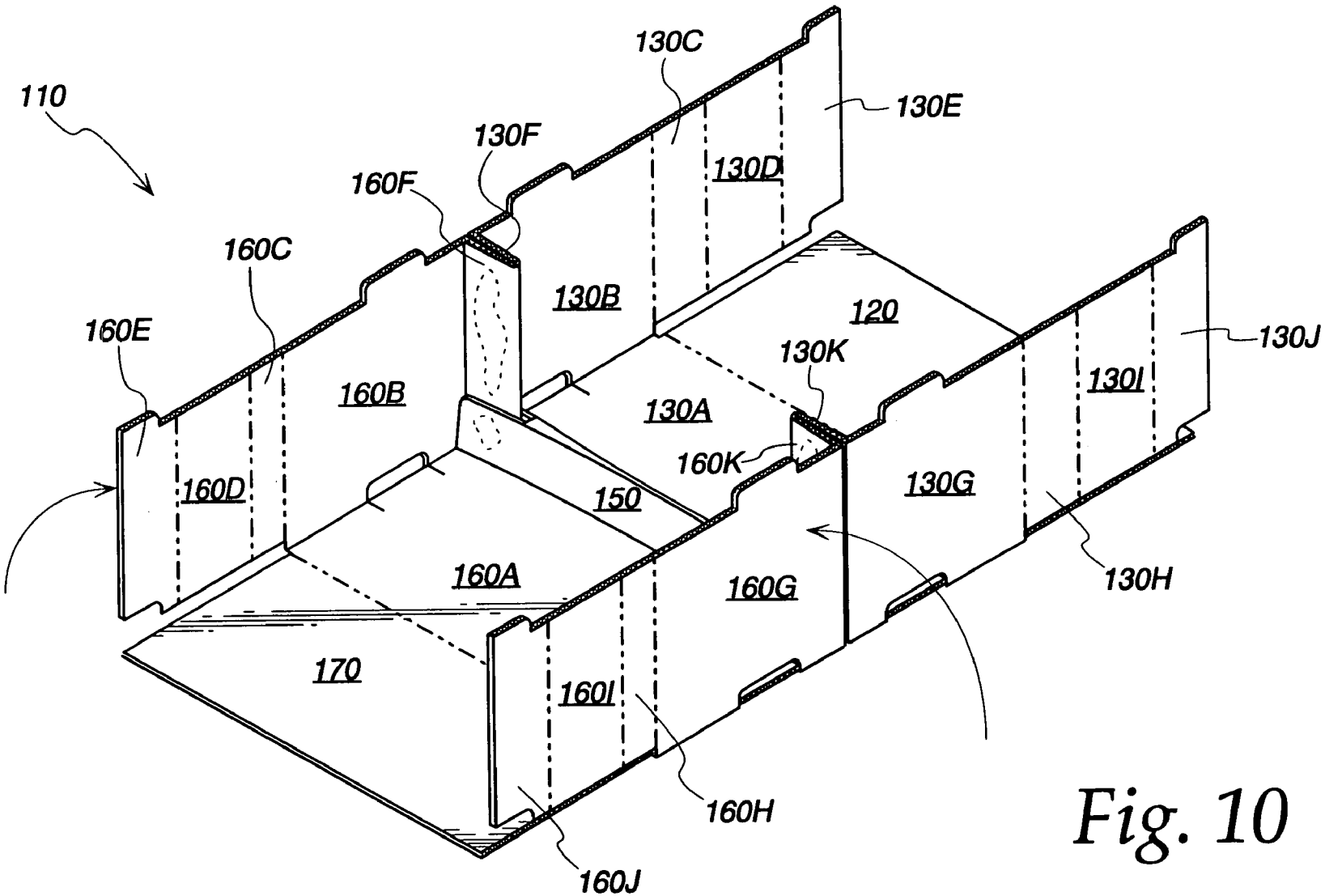
FIG. 10 shows the side panels of the blank of FIG. 9 folded into the vertical position.
Figures 11, 12:
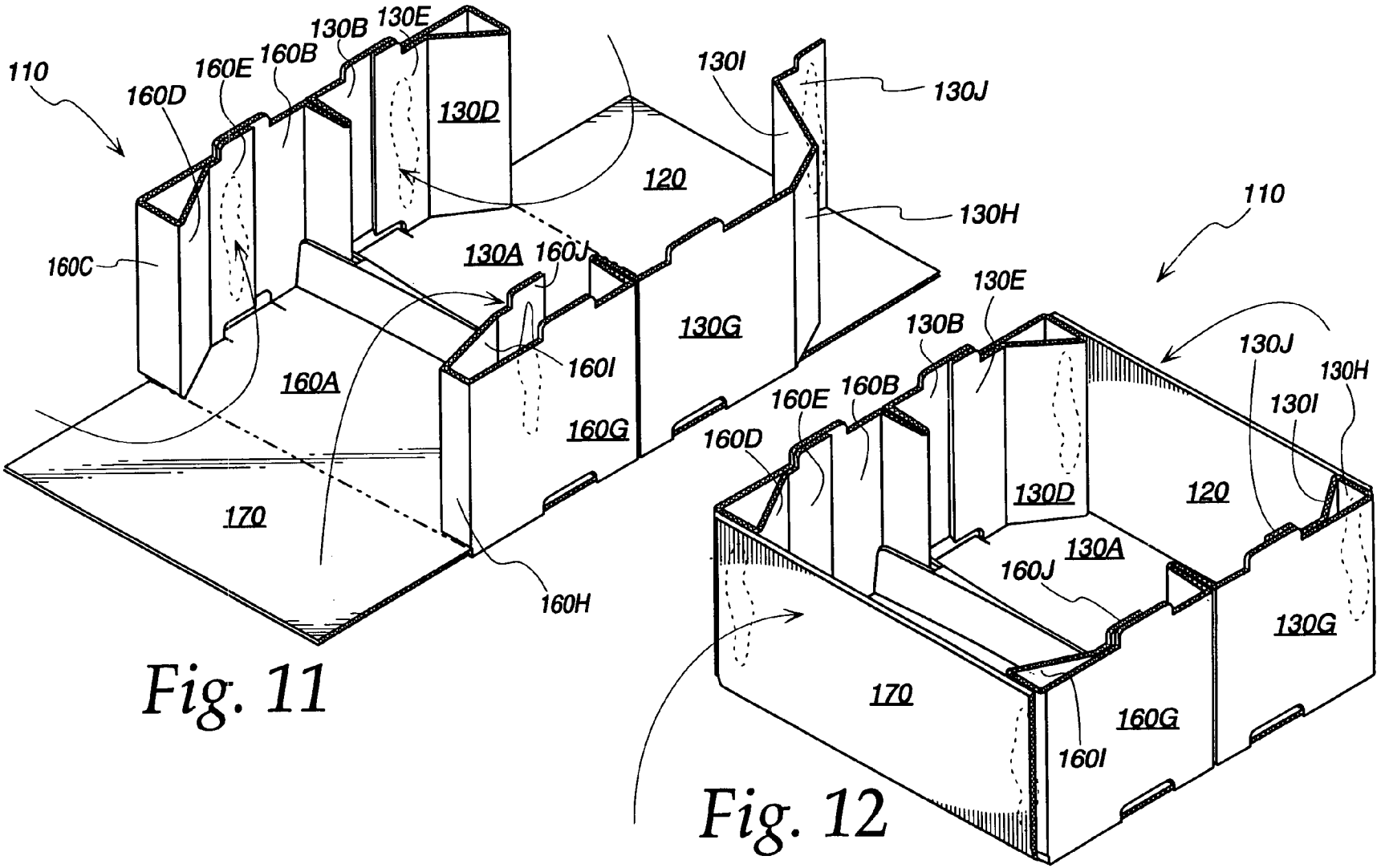
FIG. 11 shows the folding and positioning of the corner reinforcements.
FIG. 12 shows the remaining side panels folded into place, completing a second embodiment of the invention.

FIGS 7–12 illustrate a second blank for making a container of the invention, which is similar to the container of FIG. 1. Accordingly, for convenience, the parts of the blank are given the same numbering as those of FIG. 1, except that "1" has been added to each. The parts and folding of the blank into a container will not be described in detail again, but instead, attention is drawn to the transverse rib 140, 150. In FIG. 7, the middle fold is curved at the top as in FIG. 1 in order to provide increased strength to the rib when folded. The transverse rib 140, 150 is preferably glued together in the middle. In FIG. 1, the folds located where bottom panels 30A, 60A meet 40, 50 are straight while, in FIG. 7, the corresponding folds are curved. Thus, when the transverse rib 140, 150 is folded, both the top and bottom of the transverse rib are curved, as can be seen in FIG. 9, thus providing additional resistance to bowing of the bottom of the container when it is loaded with heavy produce. The effect of this configuration is also to cause the bottom panels 130A, 160A to be prestressed in the upward direction, which provides certain advantages to the user who will be loading the container with heavy produce, causing the bottom to tend to deflect and bulge. Additionally, this tends to splay the ends of the transverse rib and facilitates inserting the vertical ribs.

Figure 13:
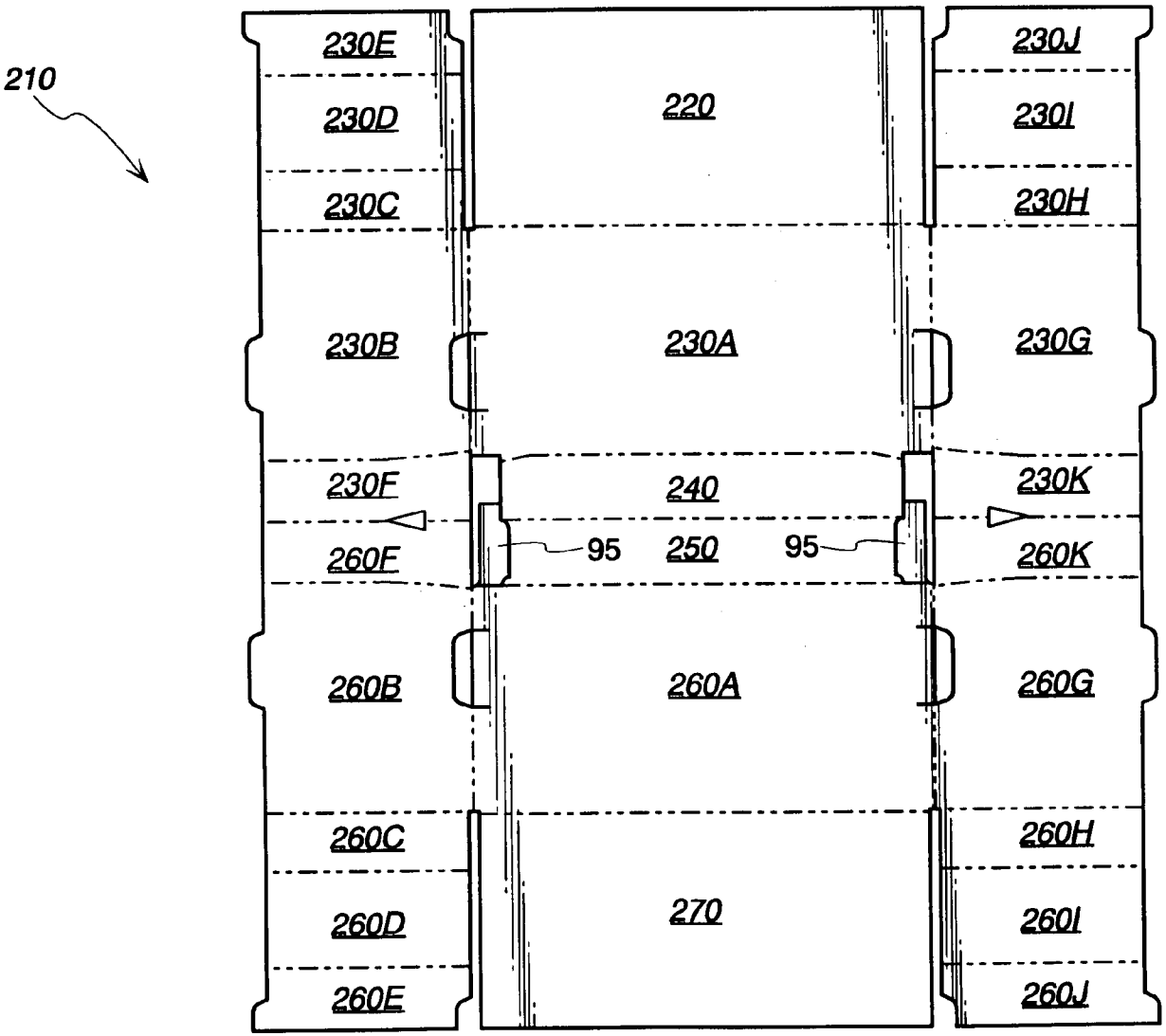
FIG. 13 is a plan view of a one-piece blank of a third embodiment of the invention.
Figure 14:
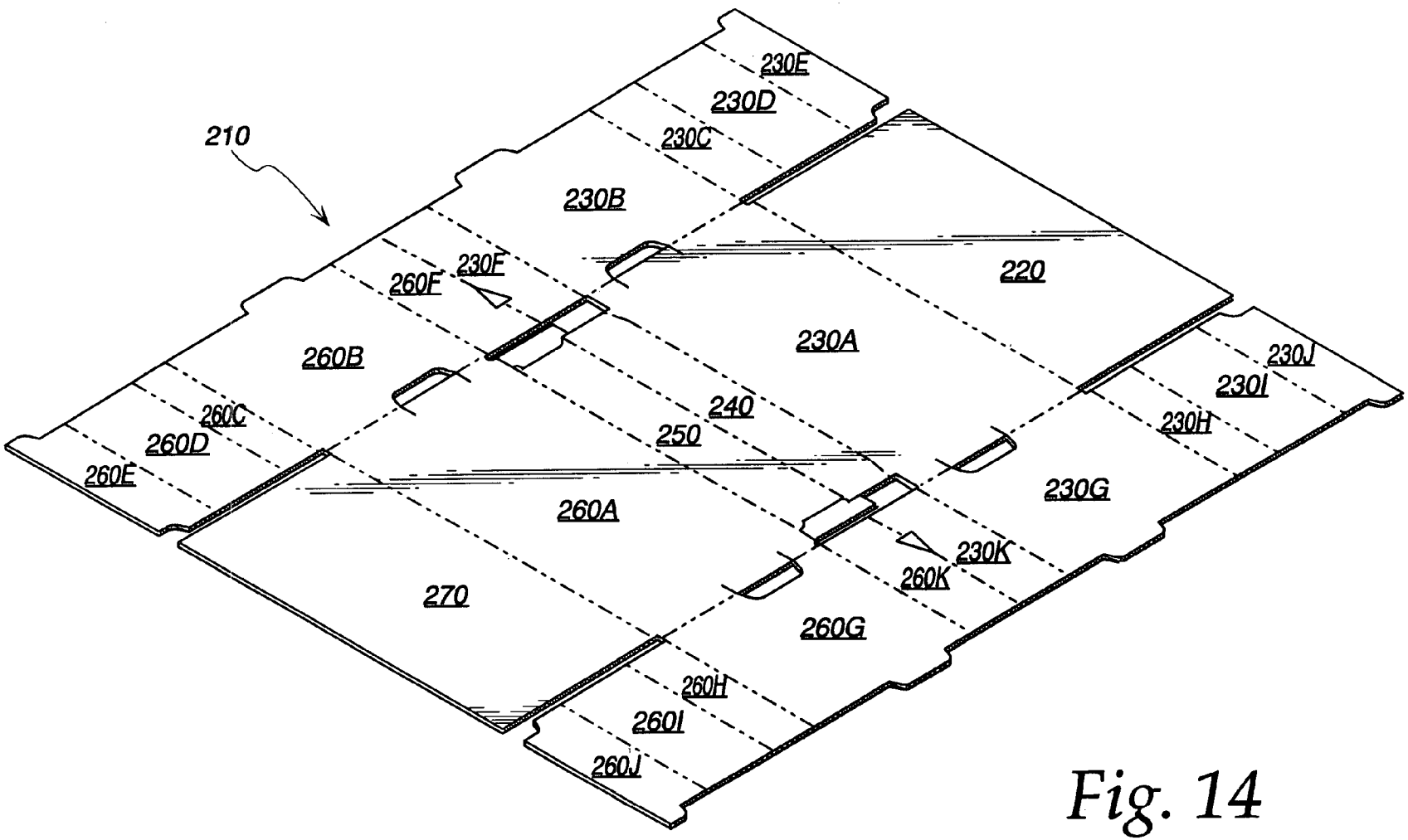
FIG. 14 is a perspective view of the one-piece blank of FIG. 13.
Figure 15:
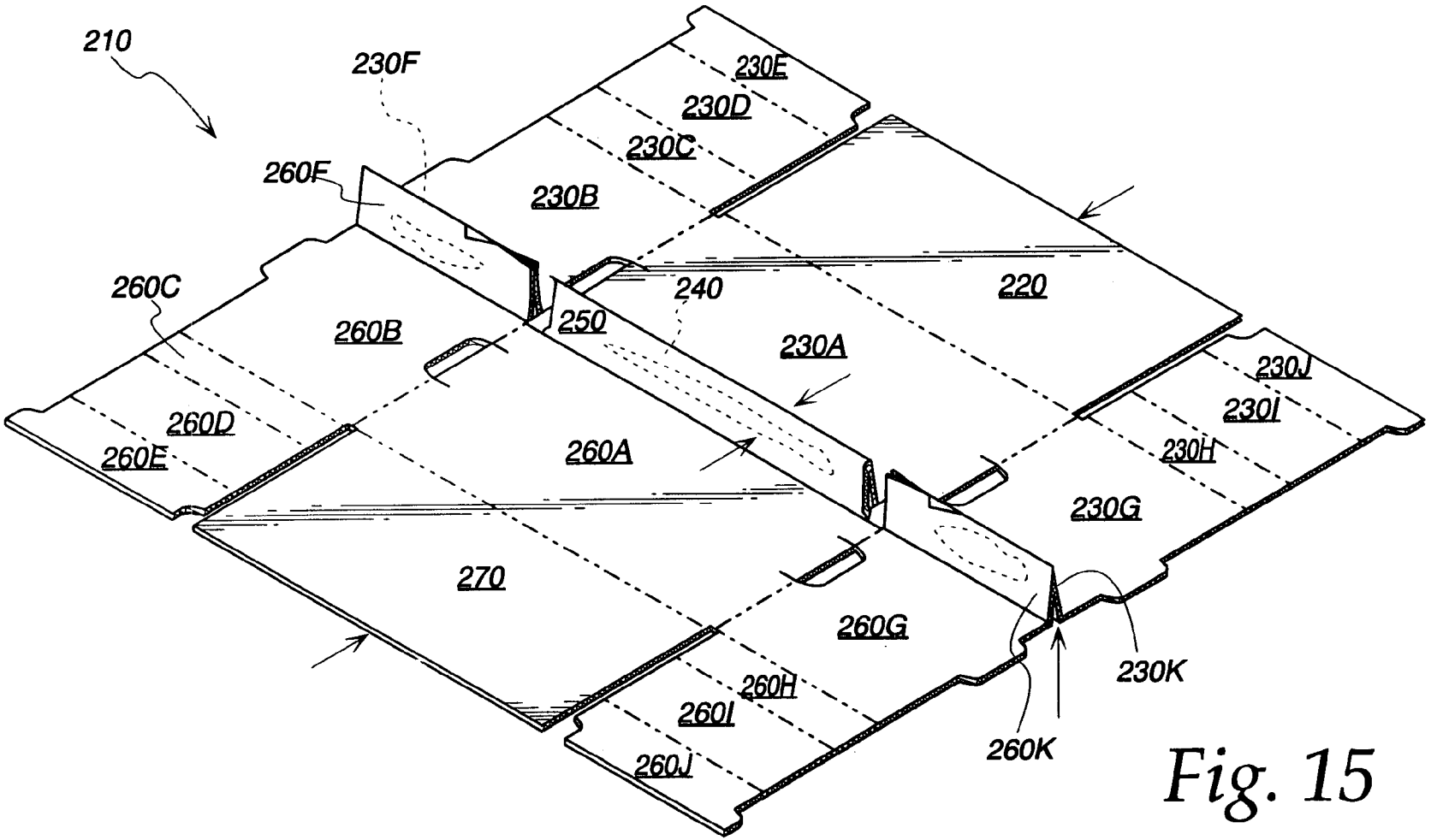
FIG. 15 shows the formation of a transverse rib and two vertical ribs from the blank of FIG. 13.
Figure 16:
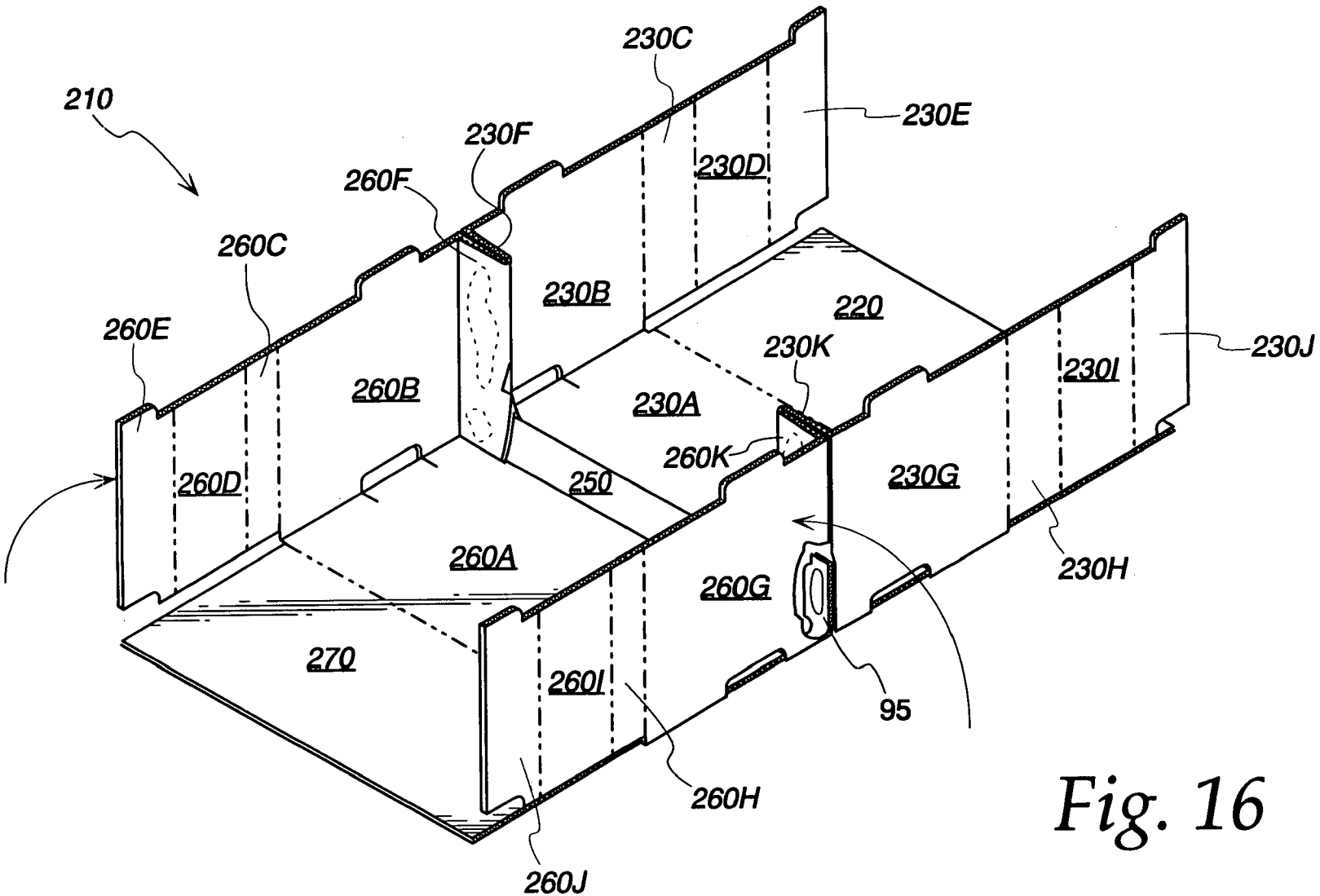
FIG. 16 shows the side panels of the blank of FIG. 15 folded into the vertical position.
Figures 17, 18:
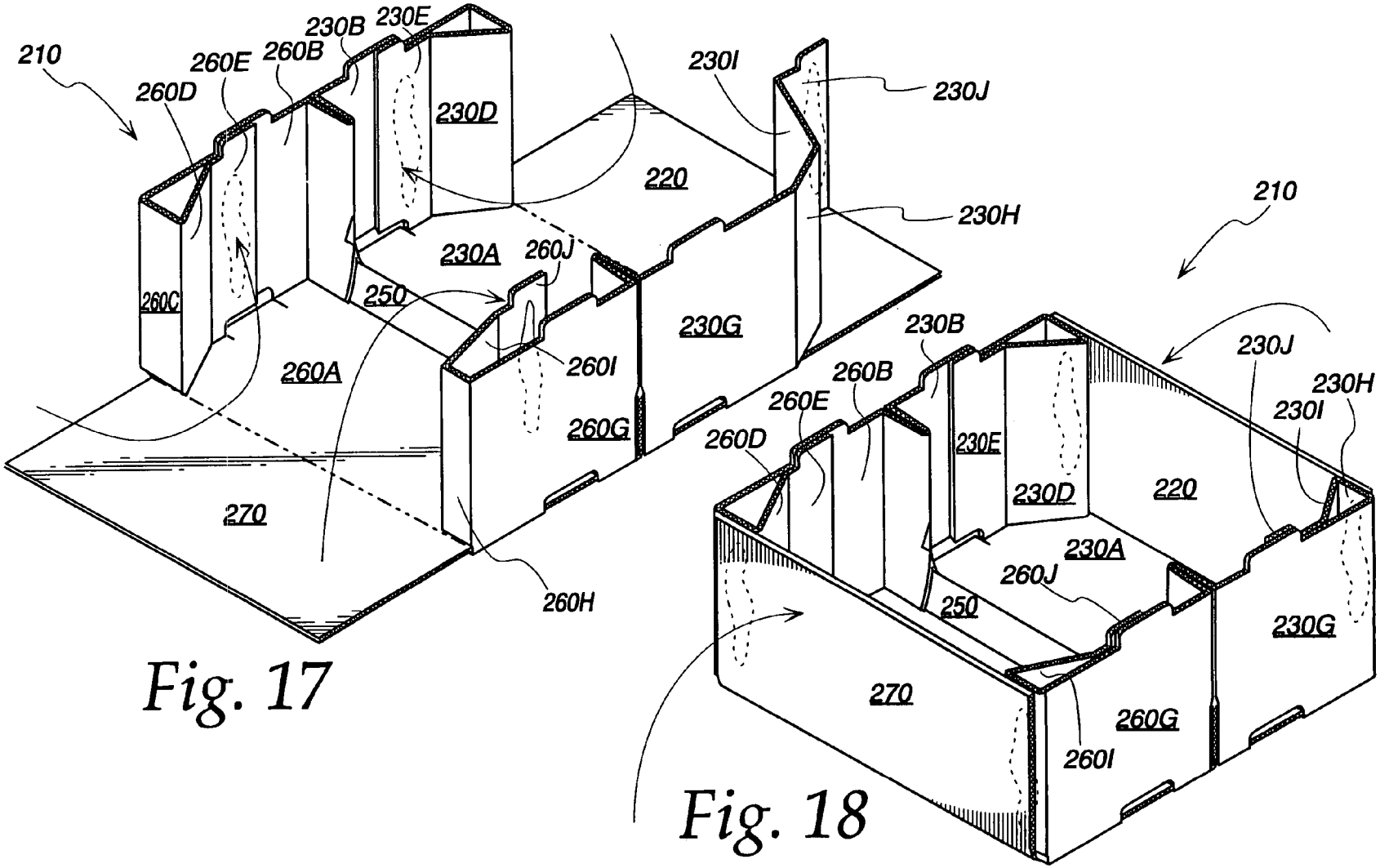
FIG. 17 shows the folding and positioning of the corner reinforcing tabs.
FIG. 18 shows the remaining side panels folded into place, completing a third embodiment of the invention.

FIGS. 13–18 represent a third embodiment similar to those of FIGS. 1–6 and 7–12. The numbering of the parts of the blank follow the same pattern as before except that "2" is used as a prefix to the numbers of FIG. 1. The difference in the container made from the blank of FIG. 13 is in the formation of the transverse rib 240, 250 and vertical ribs 230F, 260F; 230K, 260K. In this embodiment, the fold scoring is straight at the center of the blank where the bottom panels 230A, 260A meet the sides of the transverse rib and across the width of the blank, contrary to FIGS. 1–6 and 7–12 where the transverse ribs are curved. Thus, when the corresponding folds are made in the blank of FIG. 13, the sides of the transverse rib 240, 250 touch throughout the length of the rib and may be fully glued, rather than in the center in the previous embodiments. Since no space is provided for the vertical ribs within the transverse rib 240, 250, the vertical ribs 230F, 260F; 230K, 260K engage the outside of the transverse rib 240, 250, as facilitated by notches cut along the center fold line of the vertical ribs and may be glued as shown in FIG. 16. A feature of this construction is that tabs 95 are cut out of side 250 of the transverse rib. The corresponding portion of side 240 is cut away, leaving an opening as shown. When the transverse rib 240, 250 is folded together, the tabs 95 are inserted through the opening in side 240 and under the bottom of the corresponding vertical rib, to which they can be glued. This can be seen in the cutaway detail in FIG. 16. These tabs 95 provide additional strength to hold the two sections of the container together and to prevent the vertical ribs from opening when the container is loaded with heavy produce.

Figure 20:
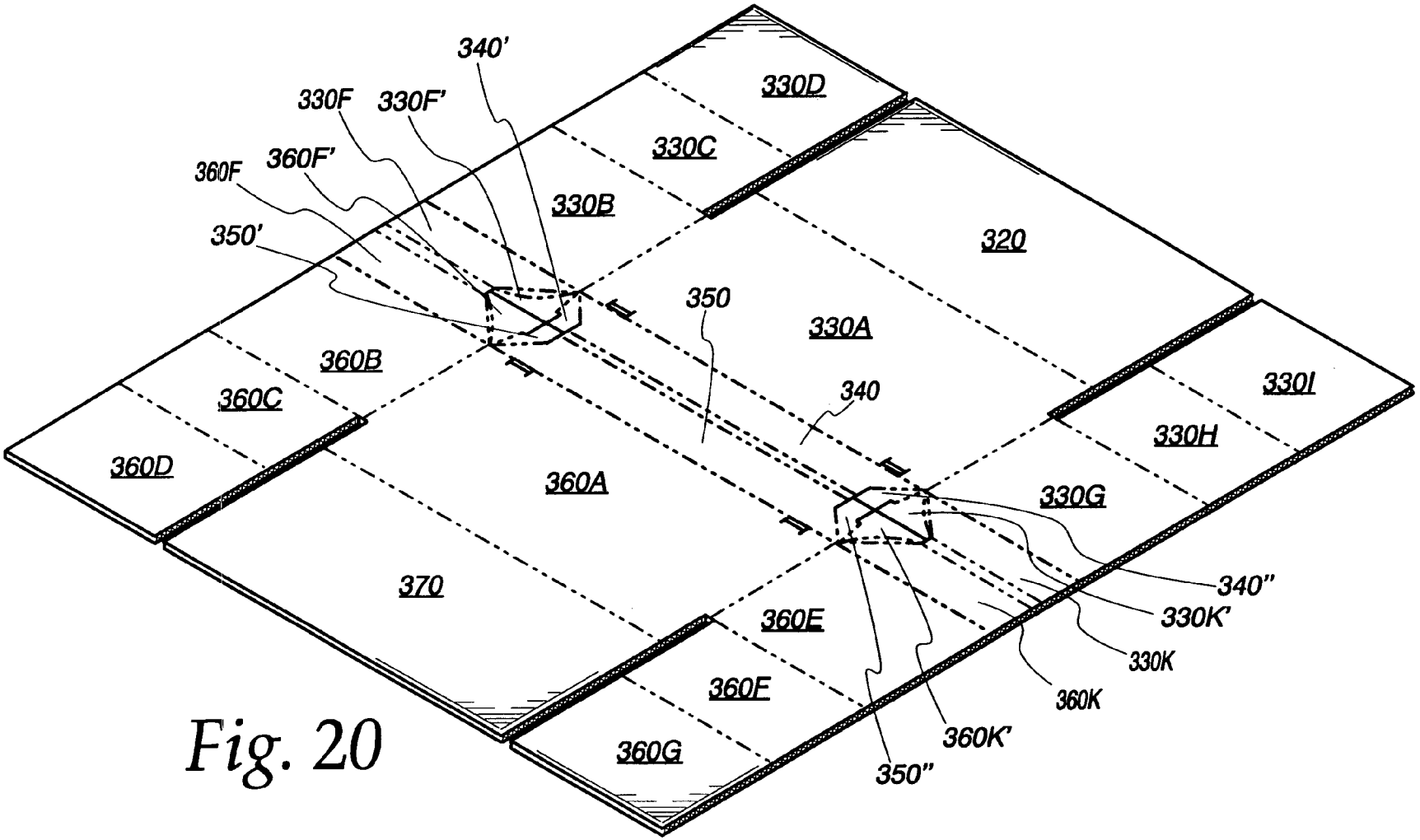
FIG. 20 is a perspective view of the one-piece blank of FIG. 19.

FIGS. 19–26 illustrate a fourth embodiment of the invention. As in the previous embodiments shown in FIGS. 1–18, the numbering of the parts of the blank and the container are retained except that a "3" has been added before each one. Also, this embodiment differs in that the corner reinforcements are only two panels instead of three, providing a different corner structure, as will be seen in FIGS. 25 and 26. In addition to that difference, the details of the intersection of the vertical and transverse ribs are modified, otherwise, the container is similar to those previously described. The transverse rib 340, 350 is made by folding along the parallel fold lines as before. The rib is straight and lacks the curved top and bottom found in some other embodiments, although such curves could be introduced, if desired. The vertical ribs 330F, 360F; 330K, 360K are made by folding along the fold lines shown generally as before. In this case, however, the middle fold is made along a pair of narrowly-spaced lines so that the vertical ribs are wider than in the other embodiments. A feature of this construction is seen in the fold lines shown at the ends of the ribs which define portions 330F' 360F' of the vertical rib 340F, 350F and the cooperating portions 340', 350' of the transverse rib. These folds are shown more clearly in FIG. 22. A cutaway portion of the surface of bottom panel 360A illustrates the direction of the corrugations in the paper stock. It can be seen that the position of the corrugations is favorable for supporting heavy loads and that when the side panels are folded up, as in FIG. 23, the corrugations are still positioned to resist loads from the heavy produce in the container. FIG. 20 is a perspective view of the blank of FIG. 19 before the blank is folded, as shown in the subsequent figures.

Figure 22:
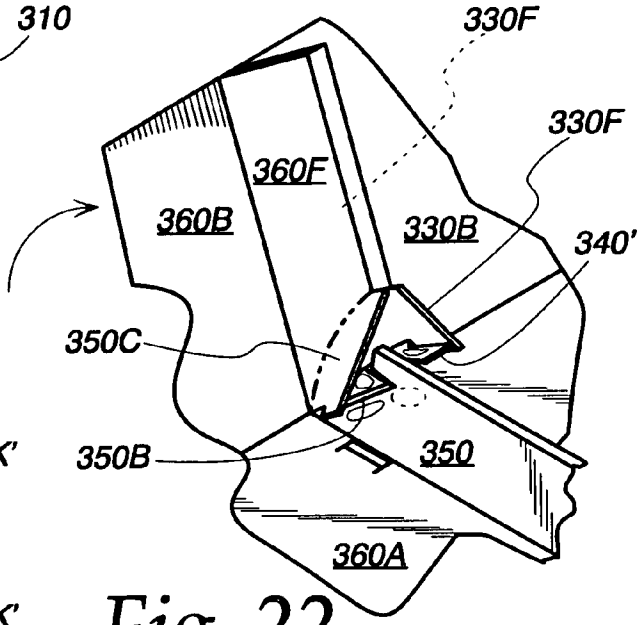
FIG. 22 is a sectional drawing in which a side panel of FIG. 21 is being raised into position.
Figure 24:
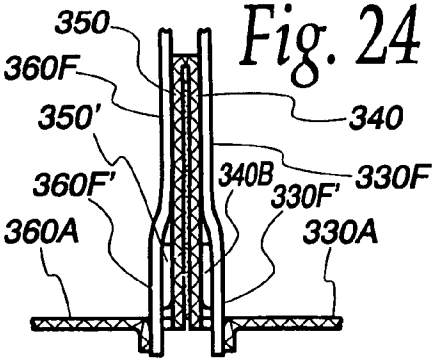
FIG. 24 is a sectional view showing the engagement of a vertical rib with the transverse rib of FIG. 23.
Figure 19:
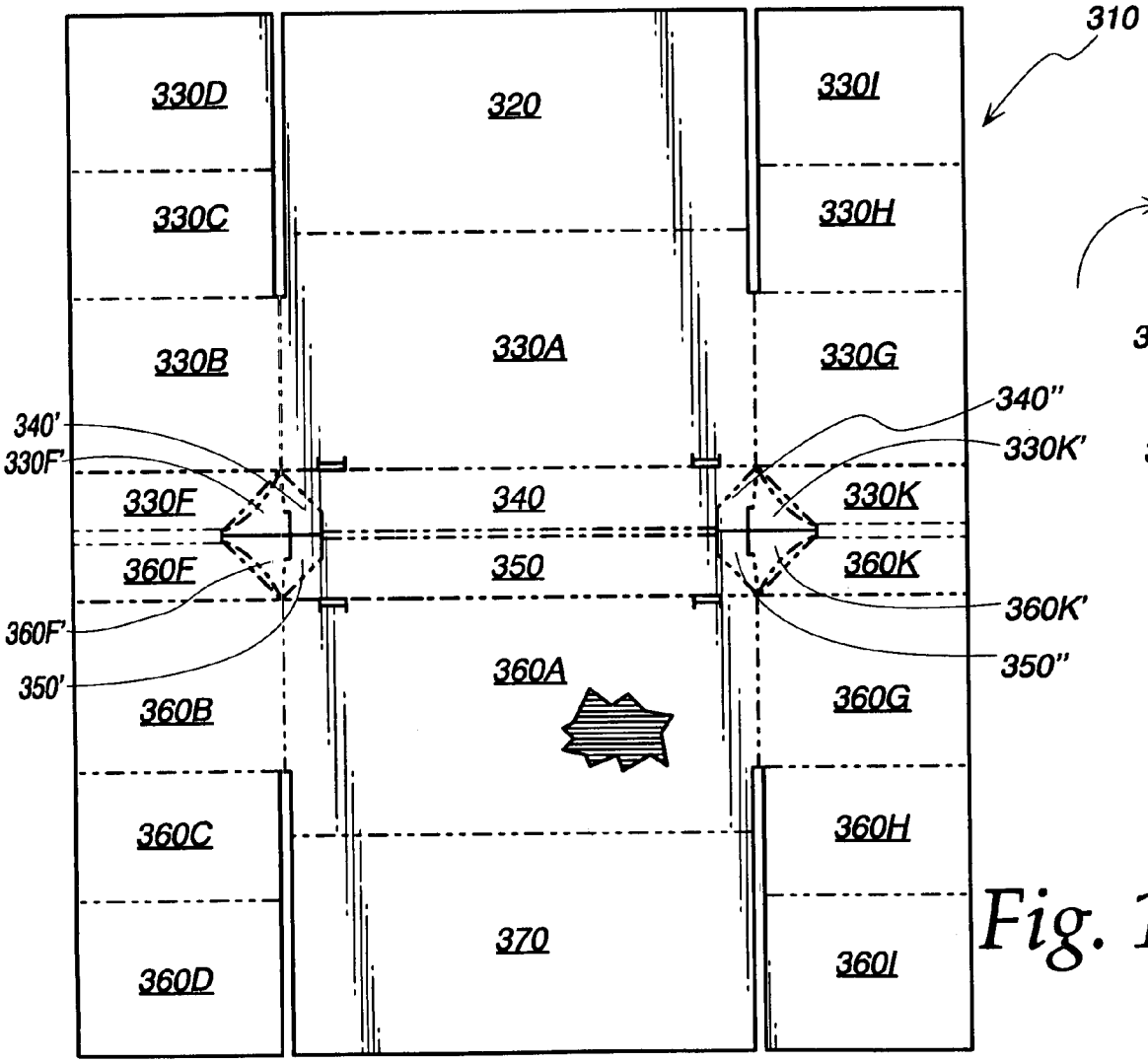
FIG. 19 is a plan view of a one-piece blank of a fourth embodiment of the invention.
Figure 21:
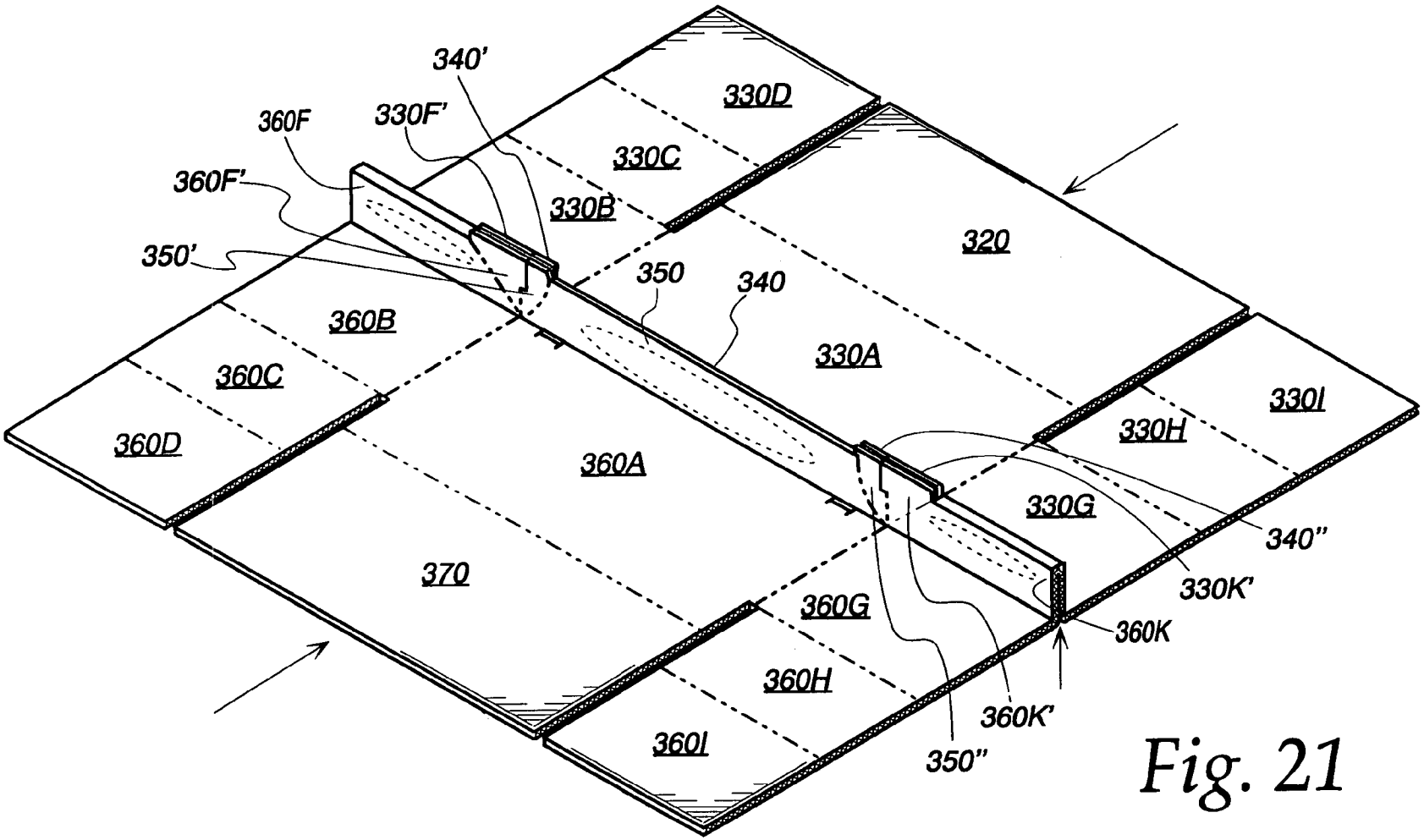
FIG. 21 shows the formation of a transverse rib and two vertical ribs from the blank of FIG. 19.

FIG. 21 shows the first folding of the blank in which both the transverse rib and the vertical ribs are formed. The ribs may be glued together to provide additional strength in the regions shown by elliptical dotted lines. The portions of the transverse and vertical ribs can be seen to be cut through so that they can be folded away from the ribs when the side panels are raised in FIGS. 22 and 23. The sectional view of FIG. 22 shows the portion 360F' of side 360F of a vertical rib 330F, 360F, which has been folded toward the side to permit moving the vertical rib over the transverse rib. The portion 350' of the 350 side of the transverse rib is also folded toward the side and will be forced against the side 350 of the transverse rib. A sectional view is shown in FIG. 24. The vertical rib 330F, 360F encloses the transverse rib 340, 350. The small folded portions 330F', 360F' of the vertical rib enclose the folded portions 340', 350' of the transverse rib and the rib itself, 340, 350. The adjacent bottom panels are 330A, 360A.

Figure 23:
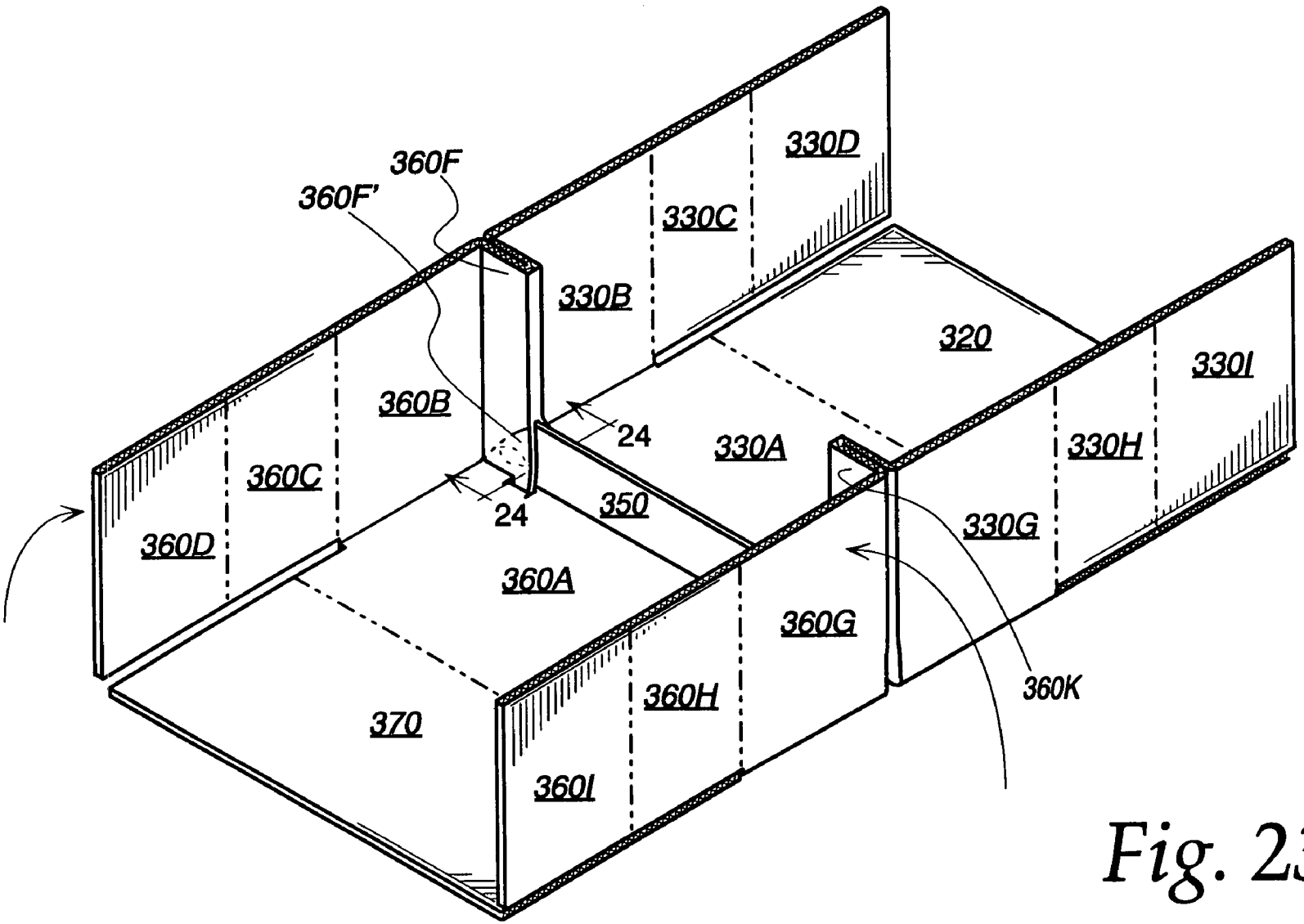
FIG. 23 shows the side panels of the blank of FIG. 21 raised into the vertical position.

As shown in FIG. 23, the transverse rib and the vertical ribs are joined when the side panels 330B, 330G, 360B, 360E are raised to the vertical position. The tabs 330C, 330D; 330H, 330I; 360C, 360D; 360H, 360I are now in position to form the reinforced corners.

Figures 25, 26:
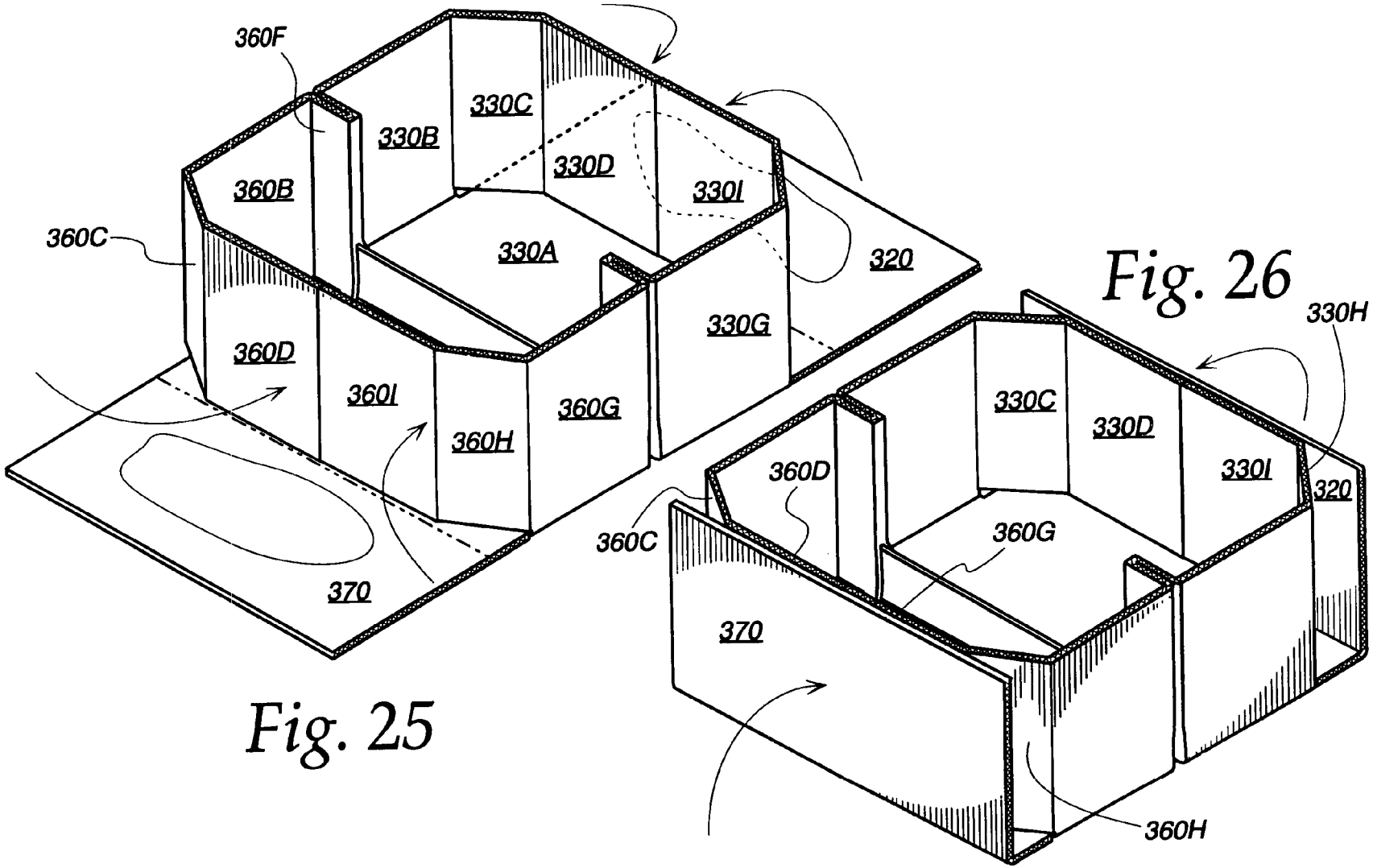
FIG. 25 shows the folding and positioning of the corners of the partially assembled container of FIG. 23.
FIG. 26 shows the remaining side panels folded into place, completing a fourth embodiment of the invention.
Figure 27:
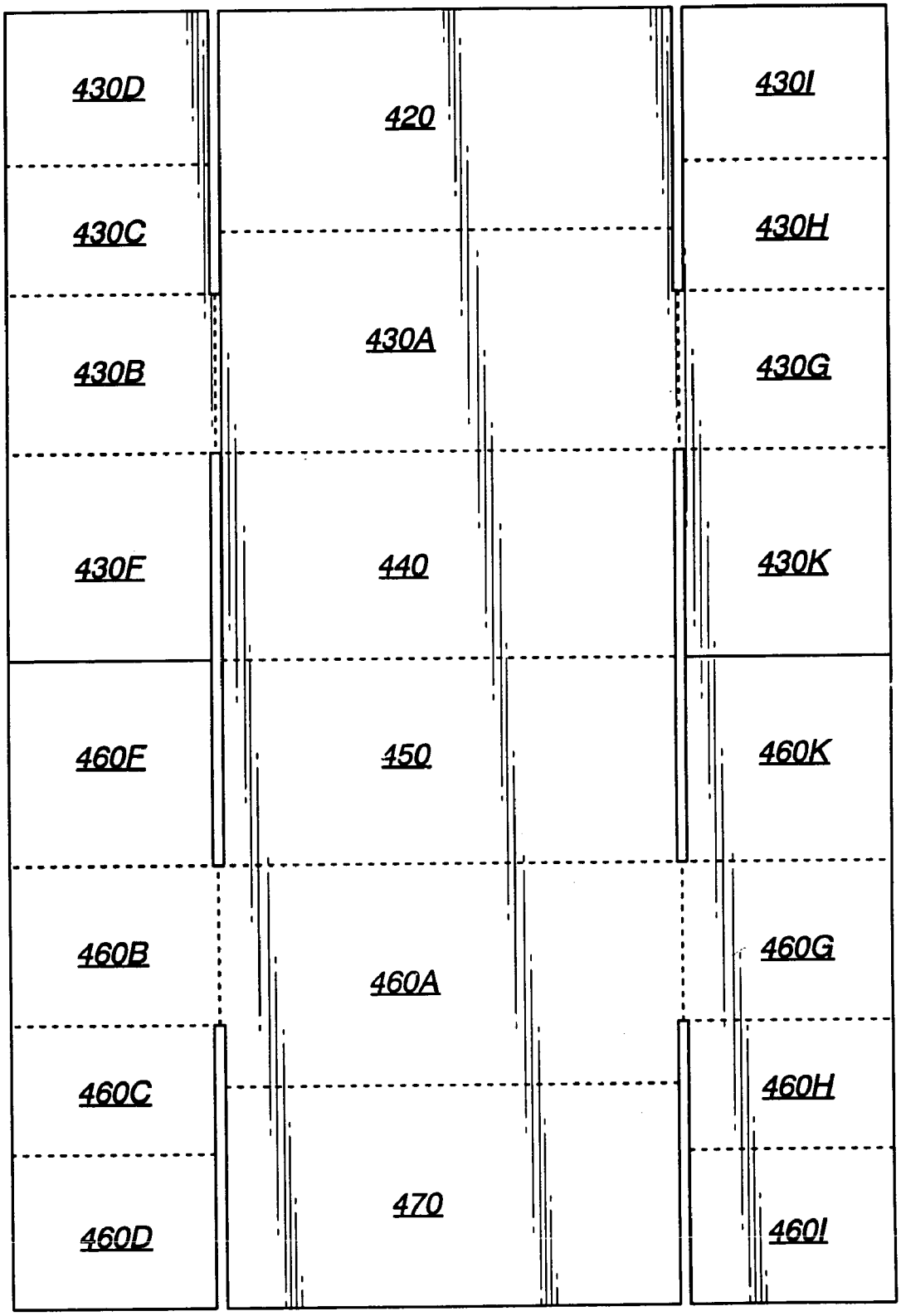
FIG. 27 is a plan view of a flat blank capable of being folded into a fifth embodiment of the invention.
Figure 28:
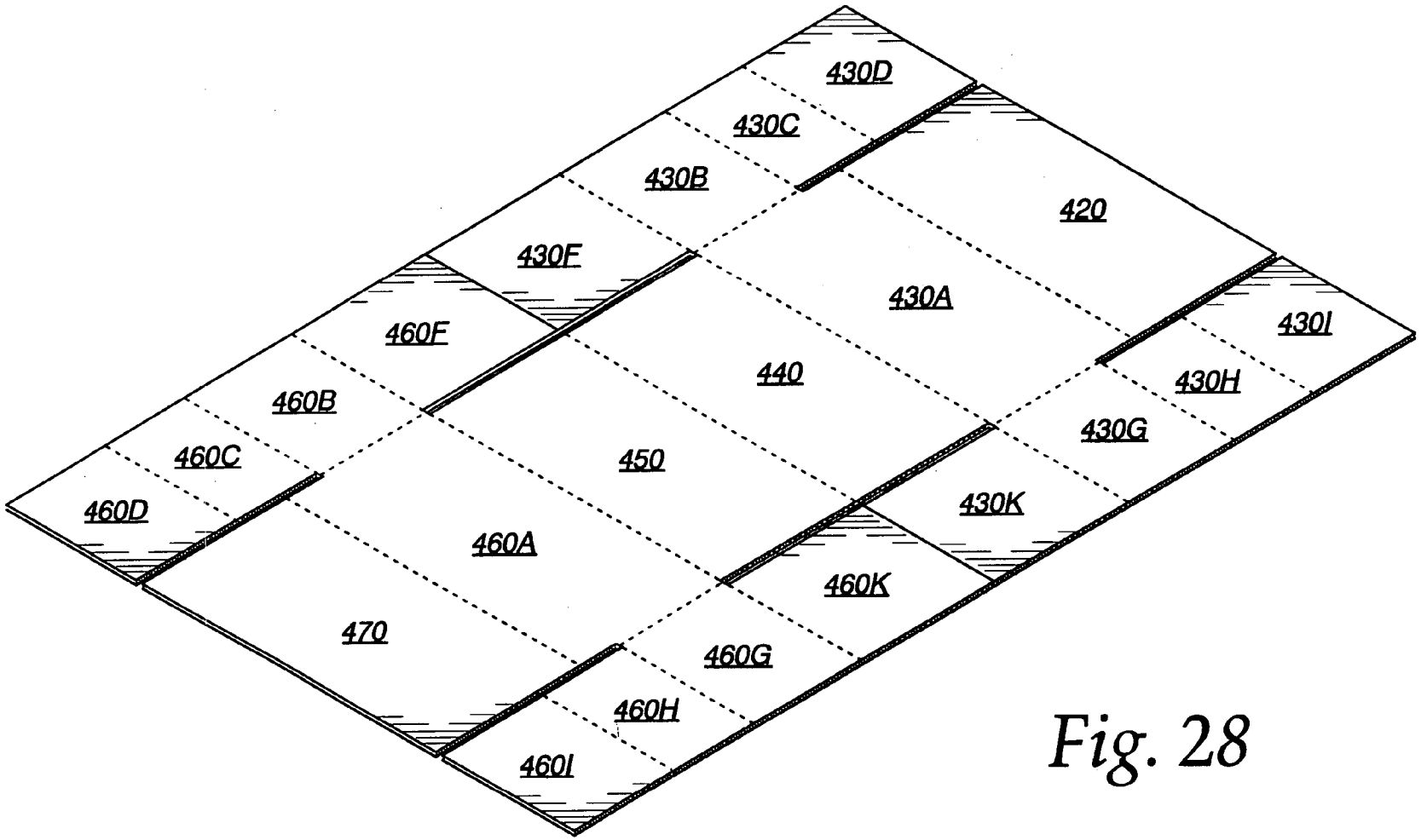
FIG. 28 is a perspective view of the one-piece blank of FIG. 27.

FIGS. 25 and 26 show the completion of the folding of the blank into a finished container. Instead of the three folds made in the containers of the previous embodiments, only two folds are made. For example, panel 360H forms an angled corner and 360I reinforces a portion of the end panel 370. When panels 370, 320 are folded into the vertical position, a portion of each is reinforced by 360D, 360I, 330D, 330I, respectively. Glue can be placed, as shown by the generally elliptical spots on the end panels 320 and 370. The completed container is shown in FIG. 26. The corners of the container may also be reinforced with three fold tabs as shown in the previously described alternatives.

Figure 29:
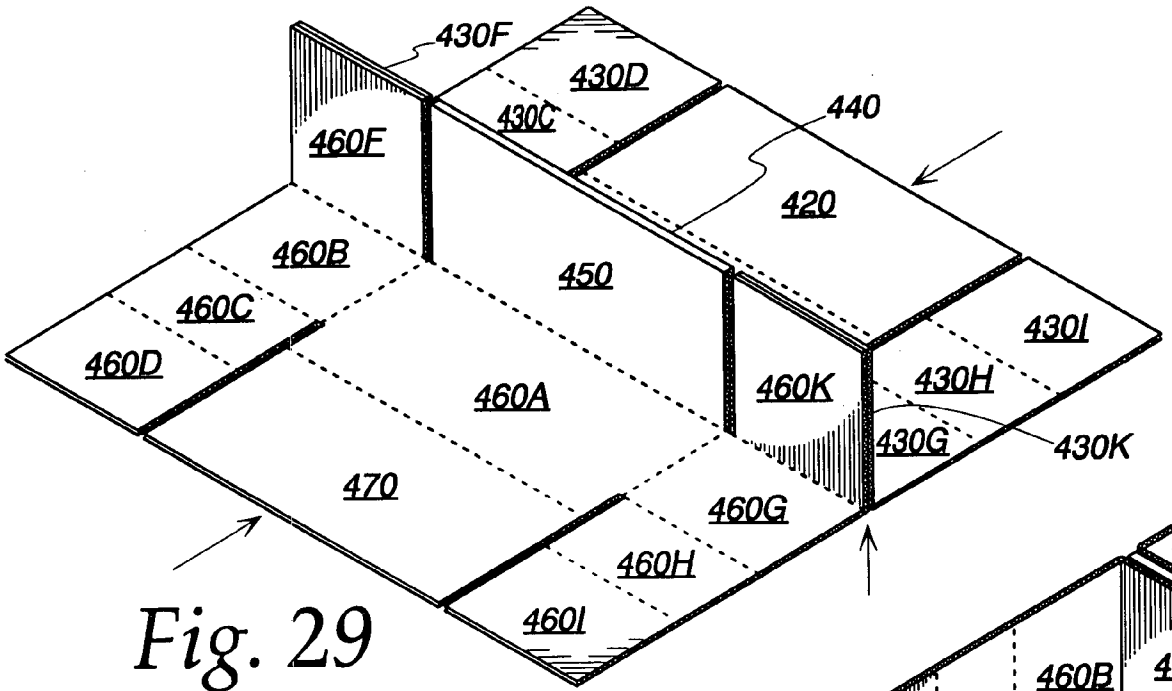
FIG. 29 shows the first fold of the blank of FIGS. 27 and 28, in which a transverse rib is formed.
Figure 30:
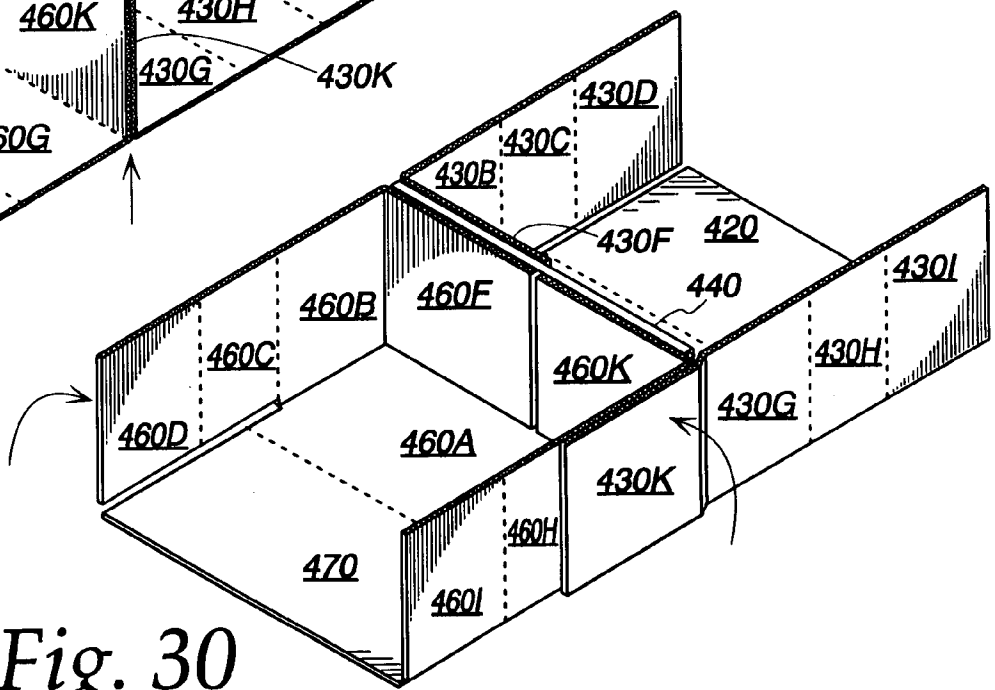
FIG. 30 shows the side walls of the blank of FIGS. 27 and 28 folded into the vertical position with two panels contacting the transverse rib on one end and on the other end one panel contacting one side of the transverse rib and one panel contacting the side of the container.
Figure 31:
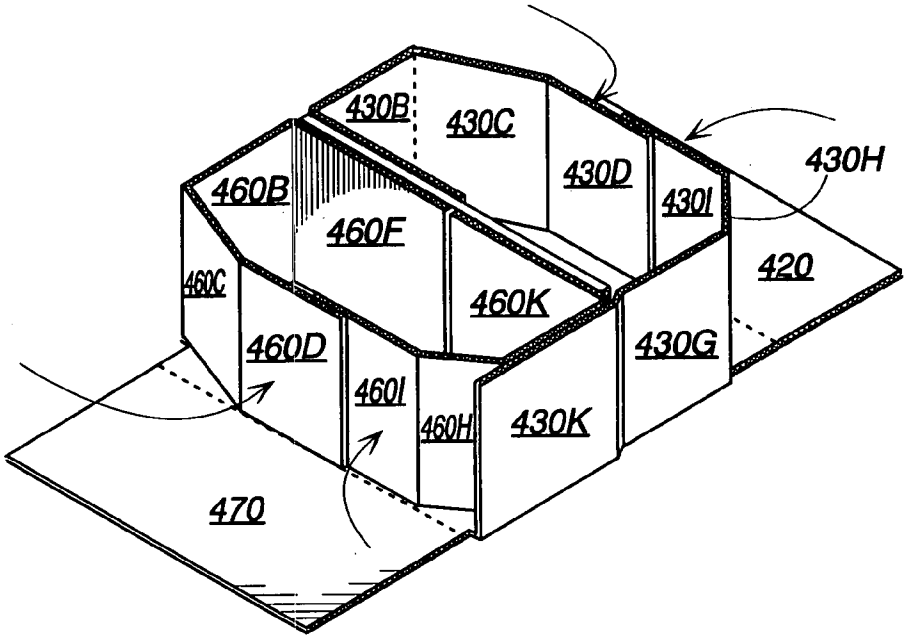
FIG. 31 shows the folding and positioning of the corners of the partially assembled container of FIG. 30.
Figure 33:
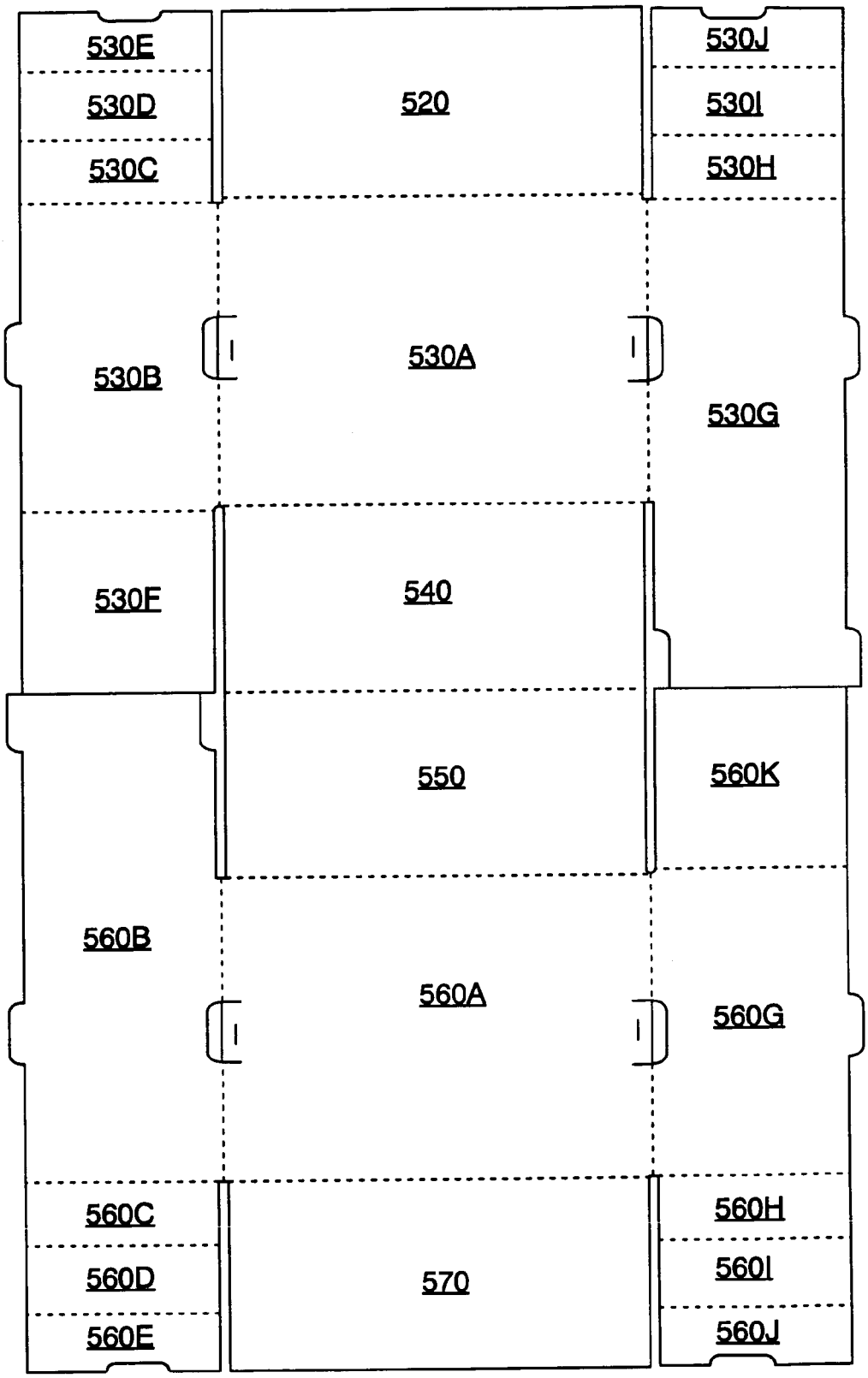
FIG. 33 is a plan view of a flat blank capable of being folded into a sixth embodiment of the invention.
Figure 34:
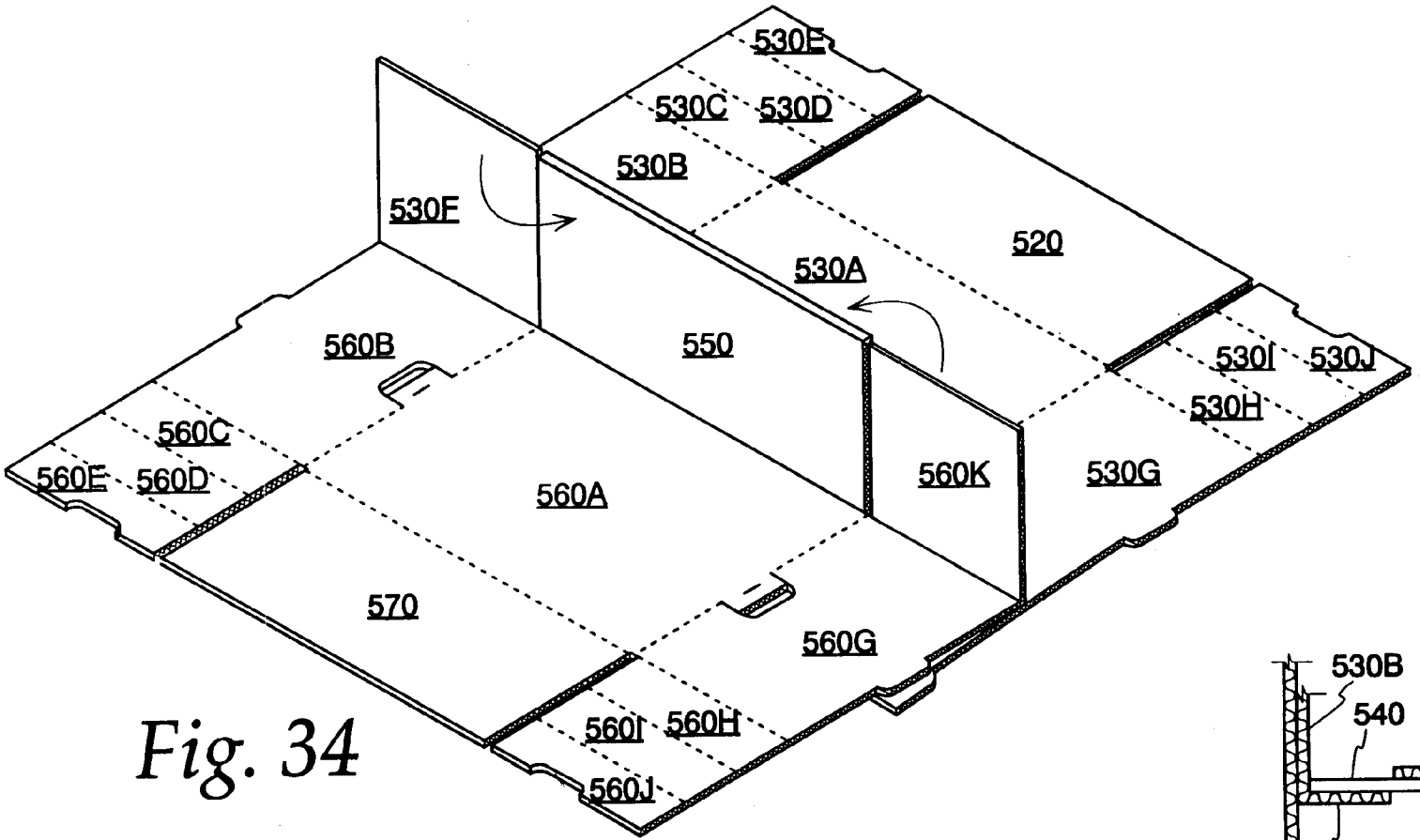
FIG. 34 is a perspective view of the blank of FIG. 33 in which a transverse rib is formed.
Figure 35:
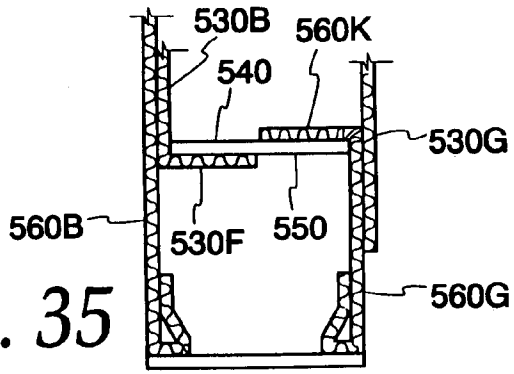
FIG. 35 shows a plan view of one end of the assembled sixth container of the invention.

FIGS. 27–32 illustrate a fifth embodiment of the invention, which differs from those of the previous figures in that the transverse rib has the same height as the side walls. Again, the same numbering system has been used, except that a "4" has been added. The fold lines on which transverse rib 440, 450 is folded are straight, so that the sides of the rib can be glued together for added strength. Since panels 430F, 460F and 430K, 460K cannot be formed into vertical ribs by folding as done in the other embodiments, the panels which correspond to the sides of the vertical ribs in the previous embodiments are modified to support the transverse rib in a different manner. In FIG. 29, it can be seen that when the transverse rib is folded, that panels 430F, 460F and 430K, 460K are attached only to adjacent panels 430B, 460B, 430G, and 460G respectively. Thus, when the sides are folded vertically relative to the bottom panels 430A and 460A, the panels which previously formed vertical ribs can be glued adjacent to the transverse rib 440, 450 or adjacent to side panels 430B, 460B, 430G, and 460G. In FIG. 30, these alternatives are both shown (although only one would be expected to be used in a single container). To the left of FIG. 30, panels 430F and 460F are shown adjacent to and glued to transverse rib 440, 450. To the right in FIG. 30, panel 460K is also adjacent the 450 side of the transverse rib, while panel 430K has been placed adjacent to side wall 460G. The reverse configuration (not shown) will be evident to one skilled in the art, that is, panel 430K could be placed adjacent the 440 side of the transverse rib and panel 460K placed adjacent side wall 430G.

The end walls 420 and 470 can be reinforced by panels 430H and I, 430C and D, 460 H and I, and 460C and D respectively in a manner similar to that of FIGS. 25–26, as shown in FIGS. 31–32. It is feasible to modify the blank so that the reinforcement of the corners is done with three-fold tabs in the same manner as shown in FIGS. 1–6, 7–12 and 13–18

FIGS. 33–36 illustrate a sixth embodiment of the invention, also having a transverse rib 540, 550 of the same height as the side walls 530B, 530G, 560B, 560G. The numbering system again corresponds to those used before, except that a "5" has been added. In this embodiment, panels 530F and 560K are folded along the dotted lines where they are attached to side walls 530B and 560G respectively. Then, when the transverse rib 540, 550 has been formed by folding along the center line shown, panels 530F and 560K are passed through the openings at the ends of the transverse rib and glued to the transverse rib, panel 530F to 550 and 560K to 540. This arrangement has the advantage of using strength of the corrugated paper connecting panels 530F and 560K to their side walls 530B and 560G respectively, in addition to the glued joint between the panels and the transverse rib. Panels 530G and 560B are not folded to create panels corresponding to panels 530F and 560K; instead they extend along the outside of side walls 530B and 560G respectively and are glued in place. In this embodiment, each corner reinforcement employs the three foldable tabs 560 C–E, 560 H–J, 530 H–J, and 530 C–E in the same manner as is shown in the first three embodiments. Alternatively, two-fold tabs could be used as shown in the fifth embodiment, or a square corner could be made from the three-fold tabs by folding only once. Optional tabs are also shown which may be used to align stacked containers as has been previously shown in the first three embodiments and discussed in connection with the first embodiment.

Figure 36:
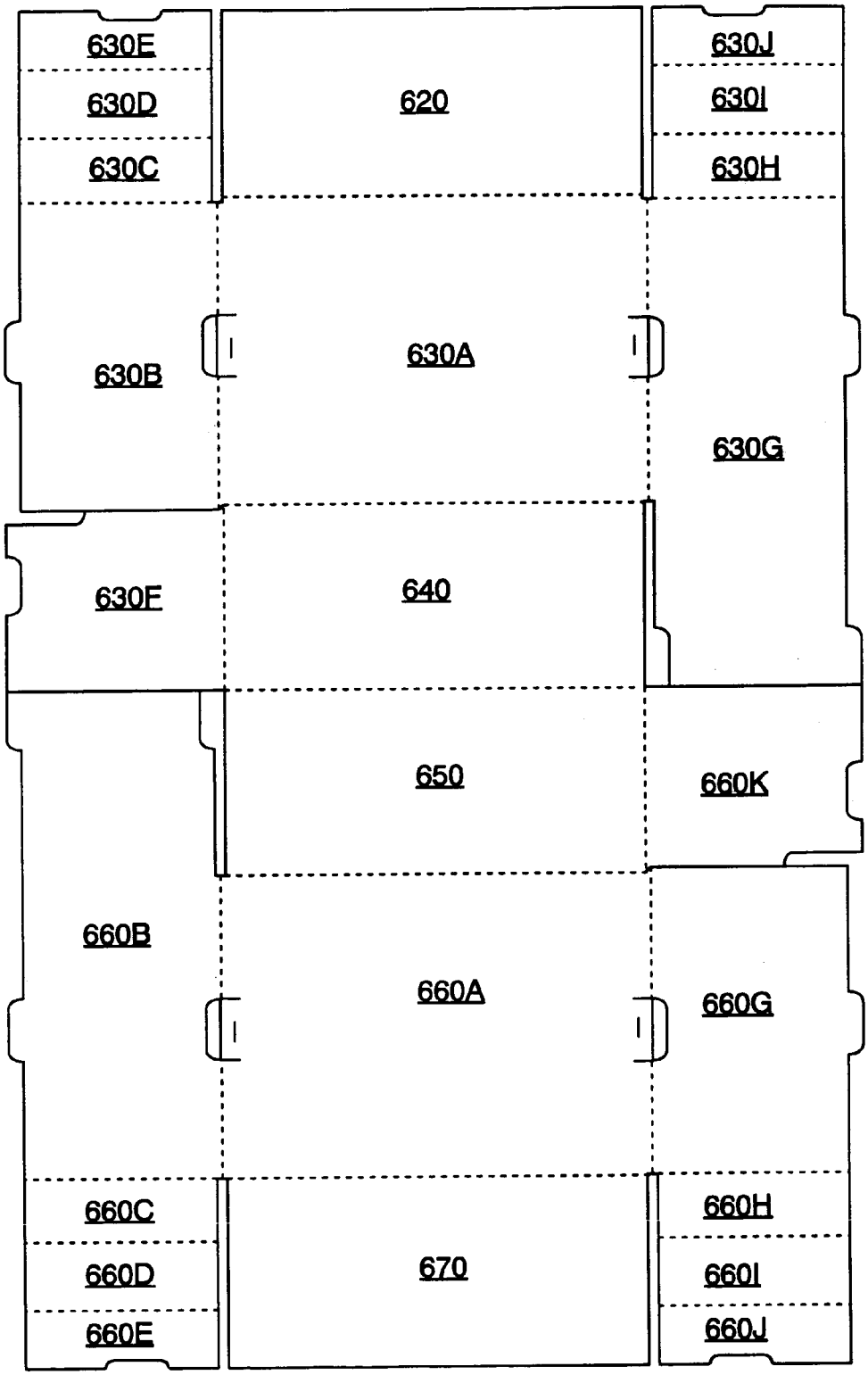
FIG. 36 is a plan view of a flat blank capable of being folded into a seventh embodiment of the invention.
Figure 37:
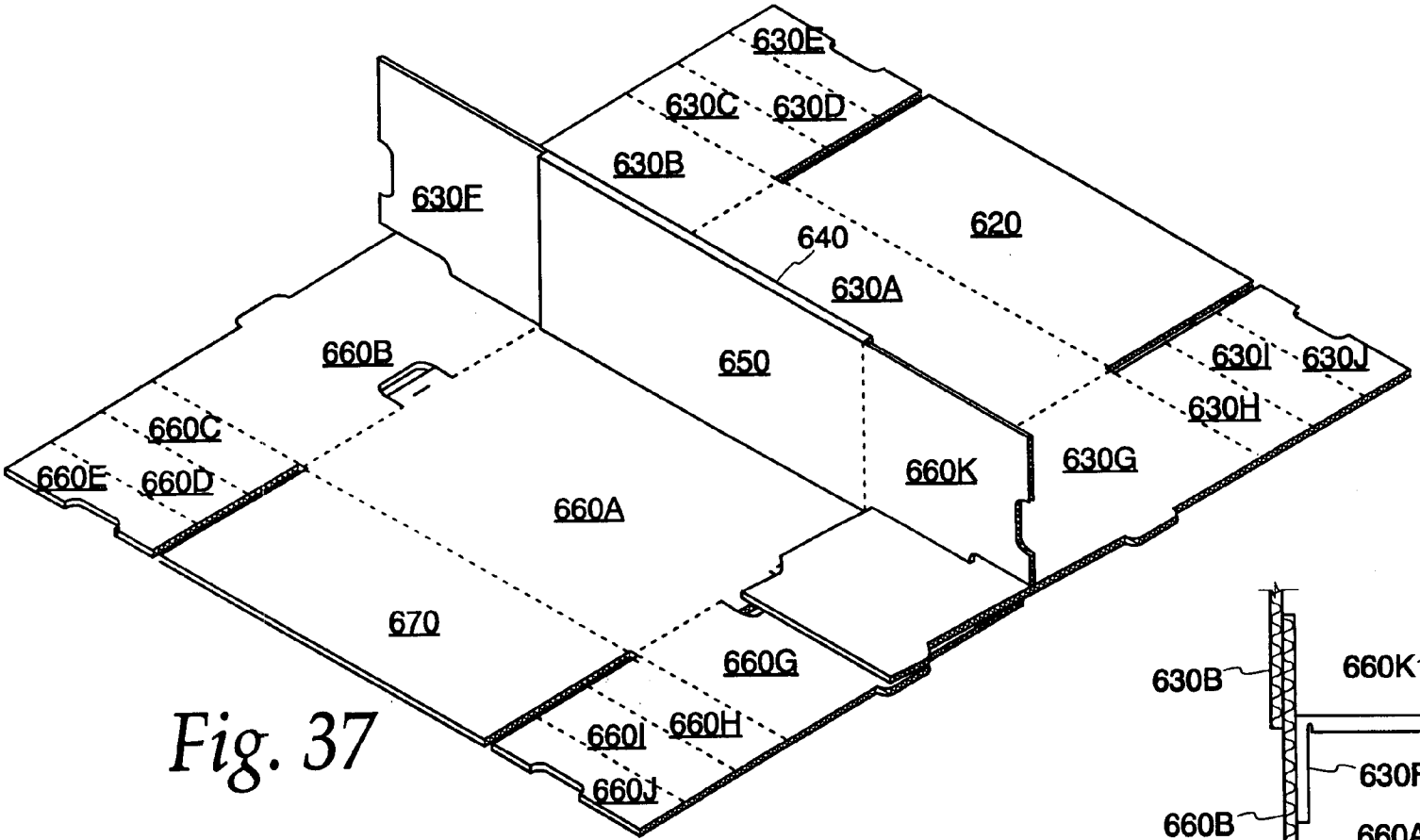
FIG. 37 is a perspective view of the blank of FIG. 36 in which a transverse rib is formed.
Figure 38:
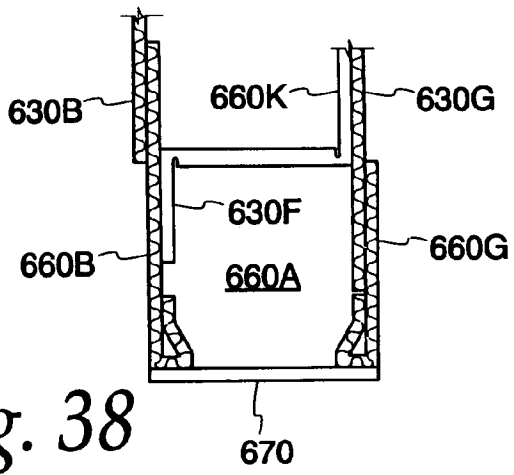
FIG. 38 shows a plan view of one end of the assembled seventh container of the invention.

FIGS. 36–38 show a seventh embodiment of the invention similar to that of the sixth embodiment. In this case, panels 630F and 660K (each panel has a "6" added to the original numbering pattern) are foldably attached to their respective sides of the transverse rib 640, 650. When the first fold is made along the panel centerline to form the transverse rib; panels 630F and 660F are folded and passed through the openings shown and glued to the adjacent side wall, that is 630F to 660B and 660K to 630G. The remaining side walls 630B and 660B are glued to the longer side wall panels 660B and 630G respectively. In this illustration, the longer side walls are positioned inside their respective shorter side walls, but the longer walls could be glued to the inside of the shorter side walls, if desired. In another variation, panels 630F and 660K could be reversed, that is panel 630F attached to 660B on the 640 side of the transverse rib and panel 660K attached to panel 630G on the 650 side of the transverse rib. The corner reinforcements are three foldable tabs, which are folded and positioned against the adjacent side and end walls as has been previously described and shown in FIG. 38. The two-fold tabs shown in the fourth and fifth embodiments could also be used, if desired, or the three-fold tabs could be folded only once and glued against the end walls 620 and 670.

While the present invention has been described with reference to one or more particular embodiments, those skilled in the art will recognize that many changes may be made thereto. Each of these embodiments and obvious variations thereof is contemplated as falling within the scope of the claimed invention, which is set forth in the following claims.

The invention claimed is:

1. A method of forming a container from a one-piece blank, the container having at least two compartments and comprising at least four side panels, two end panels and two bottom panels, the two bottom panels being separated by a transverse rib extending to the top of the side panels, the method comprising the acts of:

(a) providing the one-piece blank including at least four side panels, two end panels and at least two bottom panels;

(b) forming the transverse rib by folding the one-piece blank along a first fold line extending across the blank and defining the top of said blank at a 90° angle along two fold lines parallel to said first fold line and defining the bottom edges of the transverse rib, the transverse rib having a panel foldably attached to one end of each face thereof;

(c) securing together the two sides of the transverse rib of (b);

(d) forming the side panels by folding the side panels at a 90° angle from the folded blank of (c) and defining the two compartments in combination with the transverse rib, each of the opposing sides being formed by the combination of two side panels, each of the opposing sides having one of the side panels being longer than the other side panel, the length of the opposing sides being greater than each of the individual lengths of the two side panels;

(e) securing the two longer side panels to their adjacent side panels;

(f) folding the foldably attached panels at one end of each face of the transverse rib and securing each of the foldably attached panels to a side panel adjacent the opposite face of the transverse rib, the transverse rib extending to the top of the side panels; and (g) reinforcing the corners of the container where the end and side panels meet by folding at least once a tab at each corner of the blank to form a reinforcing panel and securing the reinforcing panel to an adjacent end panel.

2. The method of claim 1 wherein the one-piece blank is corrugated paperboard.

3. The method of claim 1 wherein the one-piece blank has exactly two compartments.

4. The method of claim 1 wherein the one-piece blank has exactly six side panels.

5. The method of claim 1 wherein the one-piece blank has exactly two bottom panels.

6. The method of claim 1 wherein the one-piece blank has exactly six side panels and two bottom panels.

* * * * *